US012060179B2

(12) United States Patent
Yao et al.

(10) Patent No.: US 12,060,179 B2
(45) Date of Patent: Aug. 13, 2024

(54) MASON JAR SEAL DEVICE

(71) Applicant: Shanghai Xinqi Electronic Technology Co., Ltd., Shanghai (CN)

(72) Inventors: Guodong Yao, Jiangxi (CN); Ling Wang, Shanghai (CN)

(73) Assignee: Shanghai Xinqi Electronic Technology Co., Ltd., Shanghai (CN)

( * ) Notice: Subject to any disclaimer, the term of this patent is extended or adjusted under 35 U.S.C. 154(b) by 0 days.

(21) Appl. No.: 18/518,664

(22) Filed: Nov. 24, 2023

(65) Prior Publication Data

US 2024/0092513 A1 Mar. 21, 2024

Related U.S. Application Data

(63) Continuation-in-part of application No. 17/944,828, filed on Sep. 14, 2022.

(30) Foreign Application Priority Data

Sep. 6, 2022 (CN) ..... 202211085654.X
Nov. 16, 2023 (CN) ..... 202330751533.3

(51) Int. Cl.
*B65D 81/20* (2006.01)
*B65B 31/02* (2006.01)
*B65B 31/04* (2006.01)

(52) U.S. Cl.
CPC ..... *B65B 31/025* (2013.01)

(58) Field of Classification Search
CPC ..... B67B 3/24; B65D 81/2038; B65B 31/025
USPC ..... 53/88; 141/65; 206/524.8
See application file for complete search history.

(56) References Cited

U.S. PATENT DOCUMENTS 2,436,849 A * 3/1948 Billetter ..... B67B 3/24 53/103
4,372,096 A * 2/1983 Baum ..... B67B 3/24 53/103
5,651,470 A * 7/1997 Wu ..... F16J 13/24 220/240
5,957,317 A * 9/1999 Lee ..... B65D 81/2038 220/240
6,662,831 B2 * 12/2003 Chen ..... F04B 41/02 53/210
7,048,136 B2 * 5/2006 Havens ..... B65D 51/1644 222/509
7,721,771 B2 * 5/2010 Tsay ..... B01J 3/006 141/83
9,359,121 B1 * 6/2016 Hsieh ..... B65D 81/2038
11,117,791 B2 * 9/2021 Alipour ..... B67B 3/24
(Continued)

*Primary Examiner* — Andrew M Tecco

(57) ABSTRACT

A mason jar seal device is provided. The mason jar sealing device includes a first container body. The first container body comprises a first container part, a first container wall surrounding the first container part and extending from the first container part, a partition coupled to an inner side of the first container wall and spaced apart from the first container part, a first barrel wall coupled with the partition for forming a first air-extraction port together with the partition, and a second barrel wall disposed on a side of the first barrel wall away from the partition for forming a second air-extraction port for communicating with the first air-extraction port. The first air-extraction port and the second air-extraction port are configured to seal different sizes of mason jars.

25 Claims, 30 Drawing Sheets

(56) References Cited

U.S. PATENT DOCUMENTS

| | | | | |
|---|---|---|---|---|
| 11,352,179 | B2 * | 6/2022 | Cabouli | G07C 9/00912 |
| 11,780,664 | B2 * | 10/2023 | Cabouli | G07C 9/00309<br>206/524.8 |
| 2018/0251355 | A1 * | 9/2018 | Alipour | B67B 7/20 |
| 2019/0367233 | A1 * | 12/2019 | Cabouli | B65D 55/14 |

* cited by examiner

A

A–A

C

B—B

D

C–C

E

F

MASON JAR SEAL DEVICE

CROSS REFERENCES AND PRIORITIES

This application is a continuation-in-part of U.S. patent application Ser. No. 17/944,828 filed on Sep. 14, 2022, which claims priority from Chinese Patent Application No. 202211085654.X filed on Sep. 6, 2022. This application also claim priority from Chinese Patent Application No. 202330751533.3 filed on Nov. 16, 2023. The contents of the above-identified applications are incorporated by reference in their entirety.

FIELD OF INVENTION

The present disclosure relates to the technical field of mason jar sealing, in particular to a multifunctional mason jar sealing device.

DESCRIPTION OF RELATED ARTS

A Mason Jar is a glass jar with a threaded iron lid that seals very well and can be used to store dry food or to pickle food. The sealer for sealing Mason Jars requires an extraction device. The above conventional sealer suffers from the following technical problems: lack of convenience. Conventional mason jar sealers need to be connected to additional evacuation equipment, such as a sealer, electric or manual pumping equipment, etc. mason jars are divided into two types of mason jars, wide mouth and standard caliber, and there is no sealer for sealing these two types of mason jars at the same time.

In view of this, overcoming the deficiencies of this prior art product is an urgent problem to be solved in the art.

SUMMARY OF THE PRESENT INVENTION

In order to solve the above-mentioned technical problems, a technical scheme adopted in this disclosure is a mason jar sealing device including a first container body comprising a first container part, a first container wall surrounding the first container part and extending from the first container part, a partition coupled to an inner side of the first container wall and spaced apart from the first container part, a first barrel wall coupled with the partition for forming a first air-extraction port together with the partition and a second barrel wall disposed on a side of the first barrel wall away from the partition for forming a second air-extraction port for communicating with the first air-extraction port.

Optionally, an inner diameter of the second barrel wall is different from an inner diameter of the first barrel wall.

Optionally, an inner diameter of the second barrel wall is greater than an inner diameter of the first barrel wall.

Optionally, an inner diameter of the second barrel wall is smaller than an inner diameter of the first barrel wall, and the second barrel wall configured to be detachably connected to the first barrel wall.

Optionally, the mason jar sealing device further comprises a first sealing portion and a second sealing portion, the first sealing portion coupled to the first barrel wall and the second sealing portion coupled to the second barrel wall.

Optionally, the first barrel wall is integral with the partition as a whole.

Optionally, the first barrel wall is surrounded by the first container wall.

Optionally, the first container body further comprises an intermediate component attached on the partition and surrounding the first barrel wall, and the second barrel wall attached on the intermediate component.

Optionally, the intermediate component comprises a fixation portion fixed to and extending away from the partition, and a bent portion extending from the fixation portion away from the first container part and bent towards the first container wall, the second barrel wall extending from the bent portion in a direction away from the partition.

Optionally, the mason jar sealing device further comprises a first sealing portion coupled to the first barrel wall and the intermediate component further comprises a gripping portion extending from the fixation portion in a direction towards the first air-extraction port for abutting against the first sealing portion.

Optionally, the partition comprises a positioning ring arranged on and protruding from a side of the partition away from the first container part, the fixation portion of the intermediate component comprises a positioning groove coupled to the positioning ring.

Optionally, the partition, is integral with the first barrel wall 106*a* and the intermediate component as a whole.

Optionally, the mason jar sealing device further comprises a mounting ring and a second sealing portion coupled to the second barrel wall, and the intermediate component further comprises a mounting portion extending from the second barrel wall towards the first container wall, the mounting ring and the mounting portion cooperatively clamp to secure the second sealing portion.

Optionally, the mason jar sealing device further comprises at least one first support protruding from the partition.

Optionally, the mason jar sealing device further comprises at least one second support protruding from the second barrel wall.

Optionally, the partition and the first container part cooperatively define a functional cavity for receiving a vacuum pump, wherein an air-extraction hole extending through the partition for communicating the vacuum pump with the air-extraction hole.

Optionally, the partition defines a recess recessed towards the functional cavity, and the air-extraction hole arranged on bottom of the recess.

Optionally, the mason jar sealing device further comprises a decompression valve received in the functional cavity, and the partition defines a decompression hole extending therethrough to communicated with the decompression valve.

Optionally, the partition further defines an air-pressure sensing hole extending therethrough the partition, the mason jar sealing device further comprises an air pressure sensor received in the functional cavity and coupled to the air-pressure sensing hole.

Optionally, the mason jar sealing device further comprises a first tube received in the functional cavity and communicating the vacuum pump with the air-extraction hole.

Optionally, the mason jar sealing device further comprising an external pumping member detachably coupled with the first container body and an extendable-retractable tube communicating the external pumping member with the first container body.

Optionally, the first container body further comprises a first through hole, and the external pumping member comprises a second through hole, the extendable-retractable tube is extendable through the first and second through holes.

Optionally, the extendable-retractable tube is detachably connected to the first through hole.

Optionally, the mason jar sealing device further comprises a three-way valve, a first tube communicating the vacuum pump with the three-way valve, and a second tube communicating the three-way valve with the air-extraction hole.

Optionally, the mason jar sealing device further comprises a third tube communicating the three-way valve with the first through hole.

In another aspect, the present invention provides a mason jar sealing device, using for sealing a first mason jar and a second mason jar with different diameters, comprising a functional cavity for receiving a vacuum pump and an air-extraction port comprising a first air-extraction port and a second air-extraction port arranged in a direction away from the functional cavity and communicated with the first air-extraction port. The vacuum pump is configured to extract air from the air-extraction port, and the first air-extraction port is configured to install the first mason jar and the second air-extraction port is configured to install the second mason jar.

Optionally, an inner wall of the first air-extraction port defines at least one first support for abutting against the first mason jar.

Optionally, an inner wall of the second air-extraction port defines at least one second support protruding from the second barrel wall for abutting against the second mason jar.

BRIEF DESCRIPTION OF THE DRAWINGS

For clearer illustration of the technical solutions according to embodiments of the present disclosure or conventional techniques, hereinafter briefly described are the drawings to be applied in embodiments of the present disclosure or conventional techniques. Apparently, the drawings in the following descriptions are only some embodiments of the present disclosure, and other drawings may be obtained by those skilled in the art based on the provided drawings without creative efforts.

DETAILED DESCRIPTION OF THE PREFERRED EMBODIMENT

Figure 1:
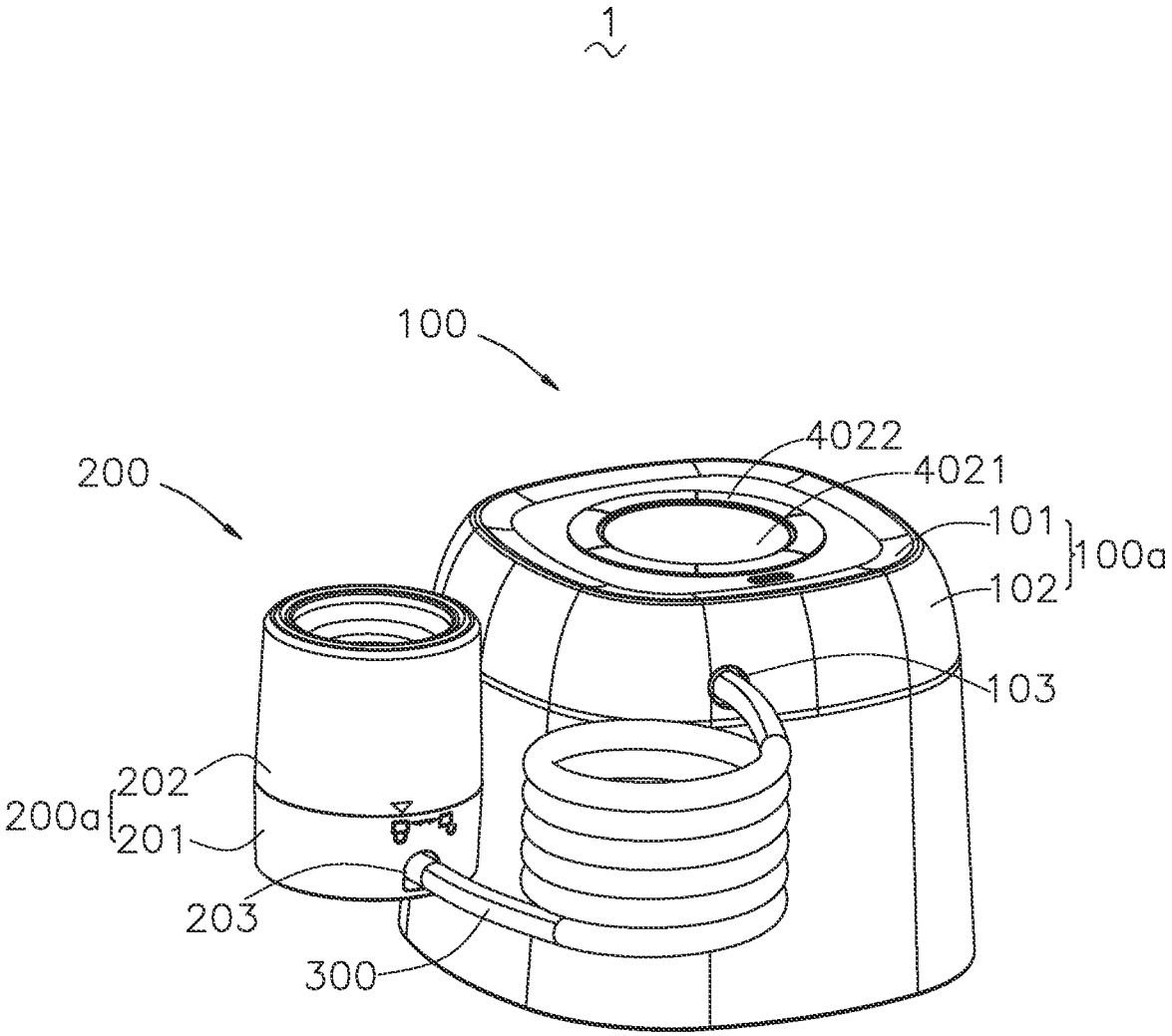
FIG. 1 is a schematic view showing the structure of a mason jar sealing device according to an embodiment of the present invention.

The technical solutions in the embodiments of the present invention will be described clearly and completely in the following in conjunction with the accompanying drawings in the embodiments of the present invention, and it is obvious that the described embodiments are only a part of the embodiments of the present invention, and not all of the embodiments. Based on the embodiments in this application, all other embodiments obtained by the person skilled in the art without making creative labor are within the scope of protection of this application.

In the description of the present invention, it is to be understood that the terms "center", "longitudinal", "lateral", "length", "width", "thickness", "top", "bottom", "front", "back", "left", "right", "vertical", "horizontal", "top", "bottom", "inside", "Outside" and the like indicate orientations or positional relationships based on those shown in the accompanying drawings, and are intended only to facilitate the description of the present invention and to simplify the description, and are not intended to indicate or imply that the device or element referred to must have a particular orientation, be constructed and operated with a particular orientation, and therefore are not to be construed as a limitation of the present invention. Furthermore, the terms "first" and "second" are used only for descriptive purposes, and are not to be construed as indicating or implying relative importance or implicitly specifying the number of technical features indicated. Thus, a feature defined with the terms "first" and "second" may expressly or impliedly include one or more features. In the description of the present invention, "more than one" means two or more, unless otherwise expressly and specifically limited.

In this application, the term "exemplary" is used to mean "used as an example, illustration, or description". Any embodiment described as "exemplary" in this application is not necessarily to be construed as preferred or advantageous over other embodiments. The following description is given to enable any person skilled in the art to realize and use the present invention. In the following description, details are set forth for purposes of explanation. It should be appreciated that one of ordinary skill in the art can recognize that the present invention can be realized without the use of these particular details. In other examples, the publicly known structures and processes will not be elaborated in detail to avoid making the description of the present invention obscure with unnecessary details. Accordingly, the present invention is not intended to be limited to the embodiments shown, but is consistent with the broadest scope consistent with the principles and features disclosed herein.

It is to be noted that the embodiment methods of the present invention, as they are executed in electronic devices, the processing objects of the respective electronic devices are in the form of data or information, such as time, which is essentially temporal information, and it is to be appreciated that subsequent embodiments that refer to dimensions, quantities, positions and the like are in the form of data corresponding to data present for the processing by the electronic devices, which is specifically not described herein.

Figure 7:
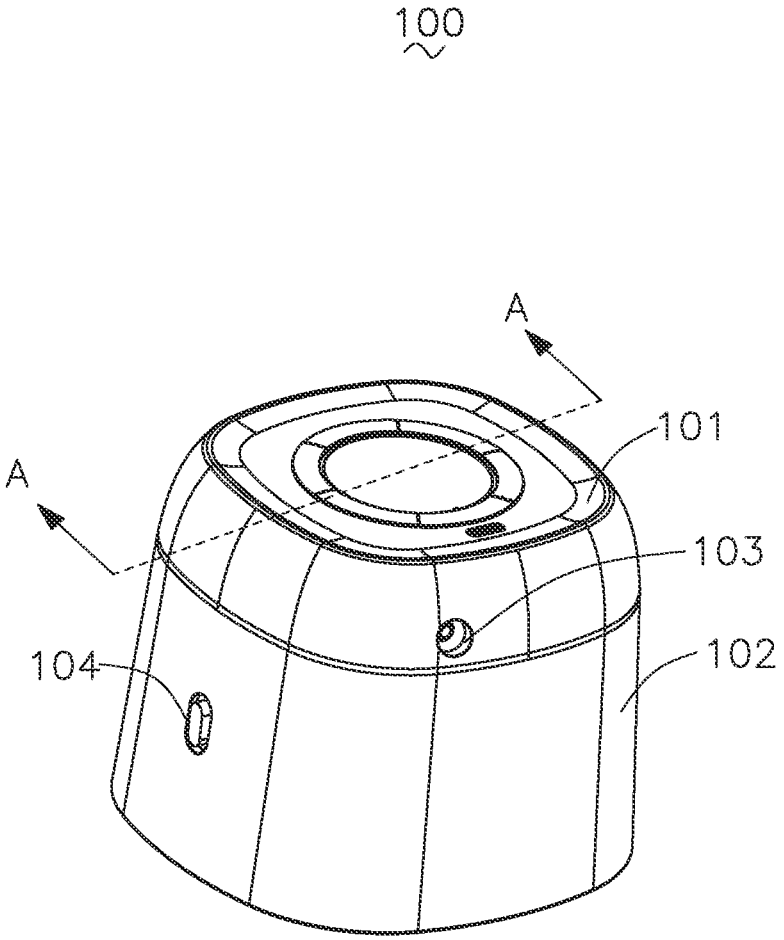
FIG. 7 is a schematic view of the structure of the first container body shown in FIG. 1.
Figure 8:
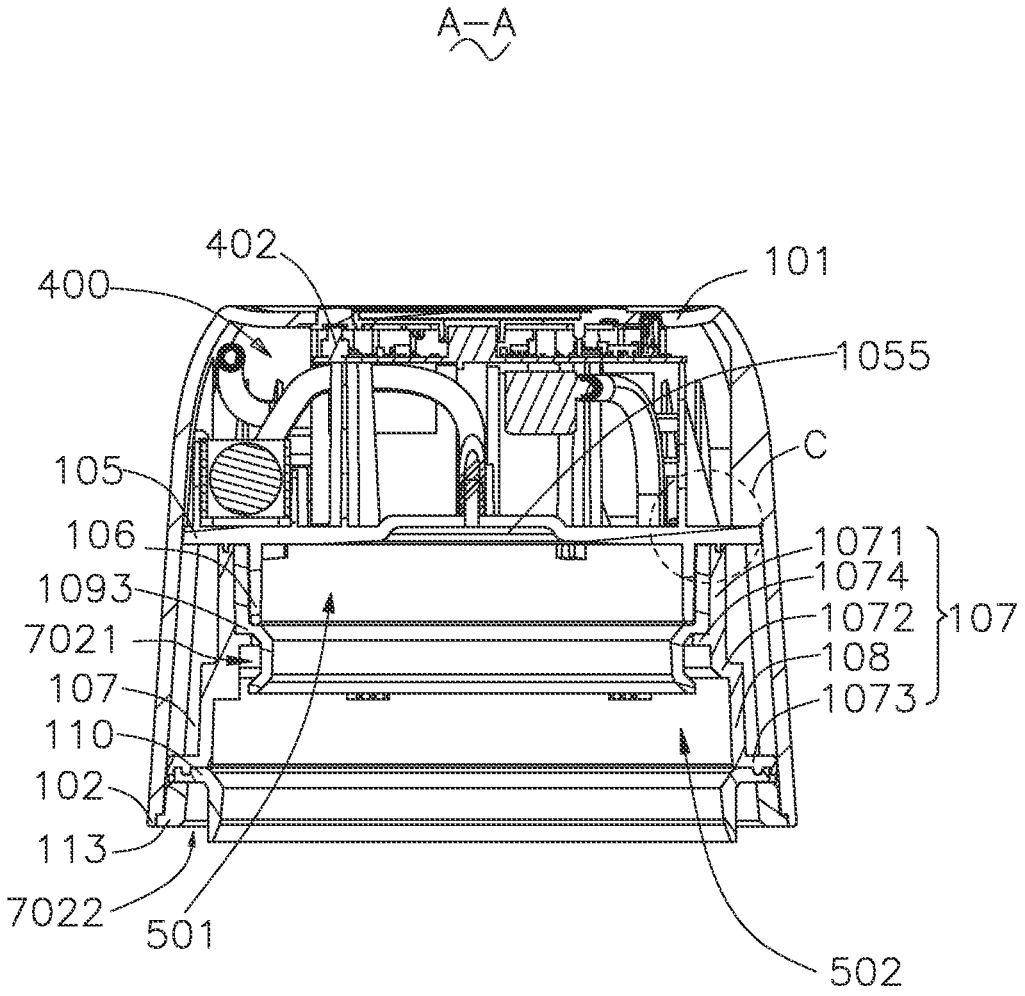
FIG. 8 is a schematic view of a cross-sectional structure of the first container body that is cut along a cross section A-A and that is shown in FIG. 7.
Figure 9:
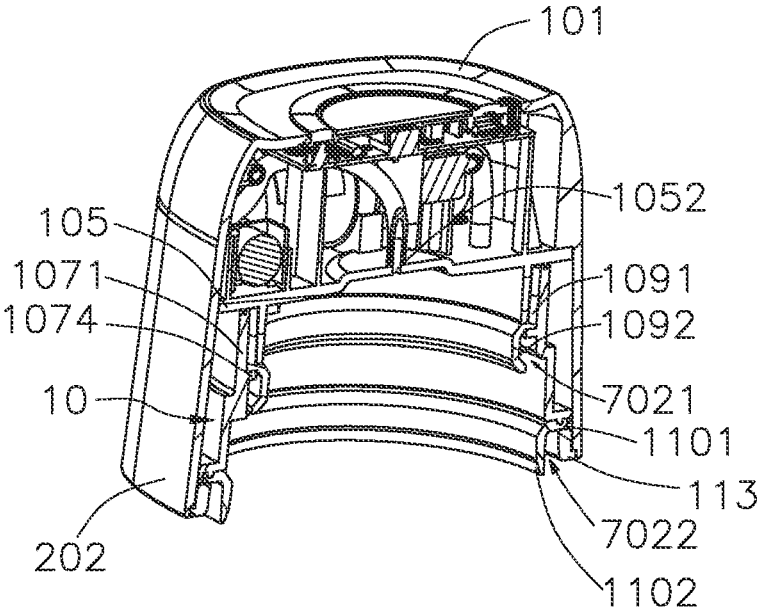
FIG. 9 is a schematic view of the structure of the first container body shown in FIG. 8 from another perspective.
Figure 10:
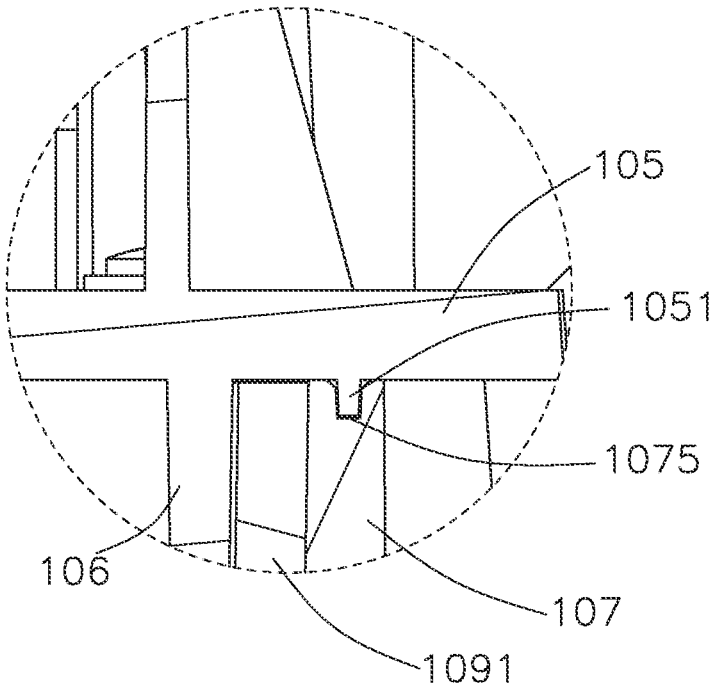
FIG. 10 is an enlarged schematic view of the structure of the first container body shown in FIG. 8 at a position C.
Figure 11:
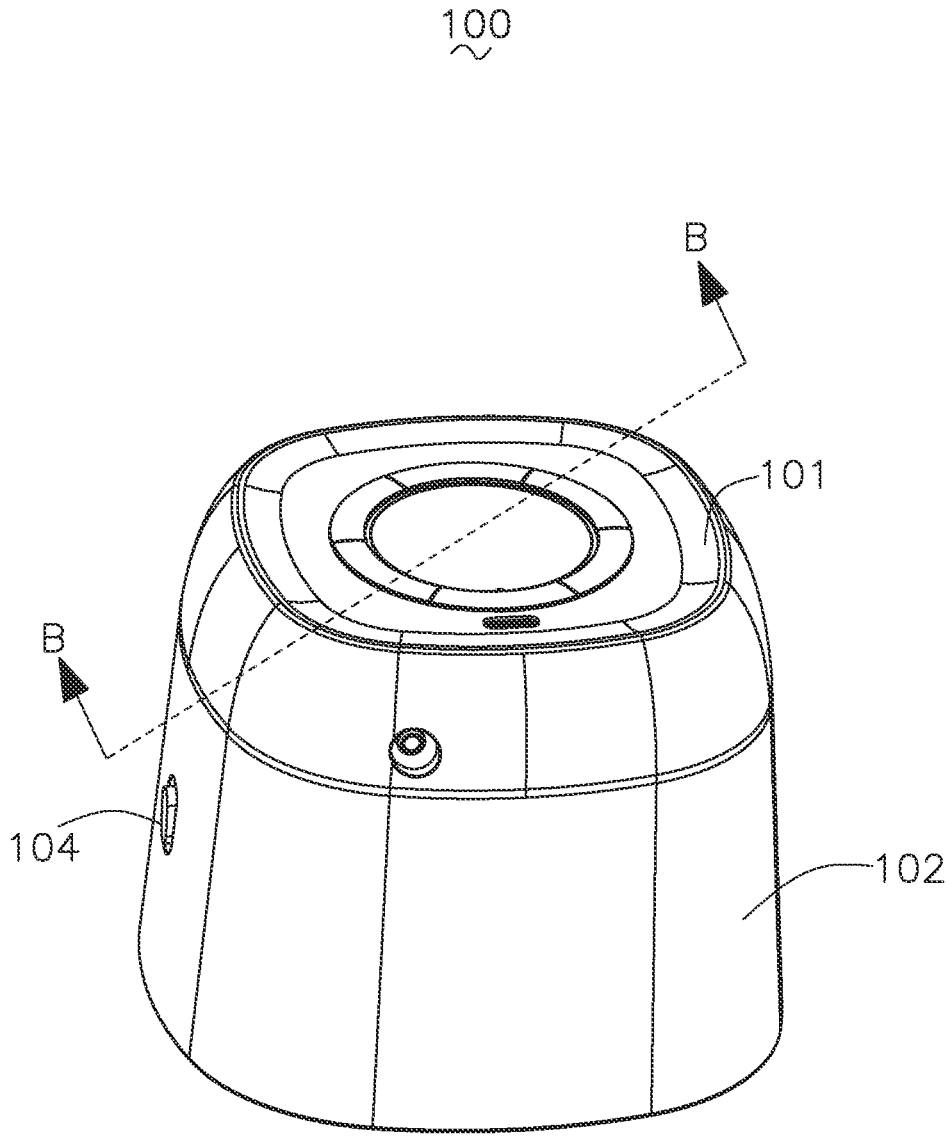
FIG. 11 is a schematic view of the structure of the first container body shown in FIG. 7 from another perspective.
Figure 12:
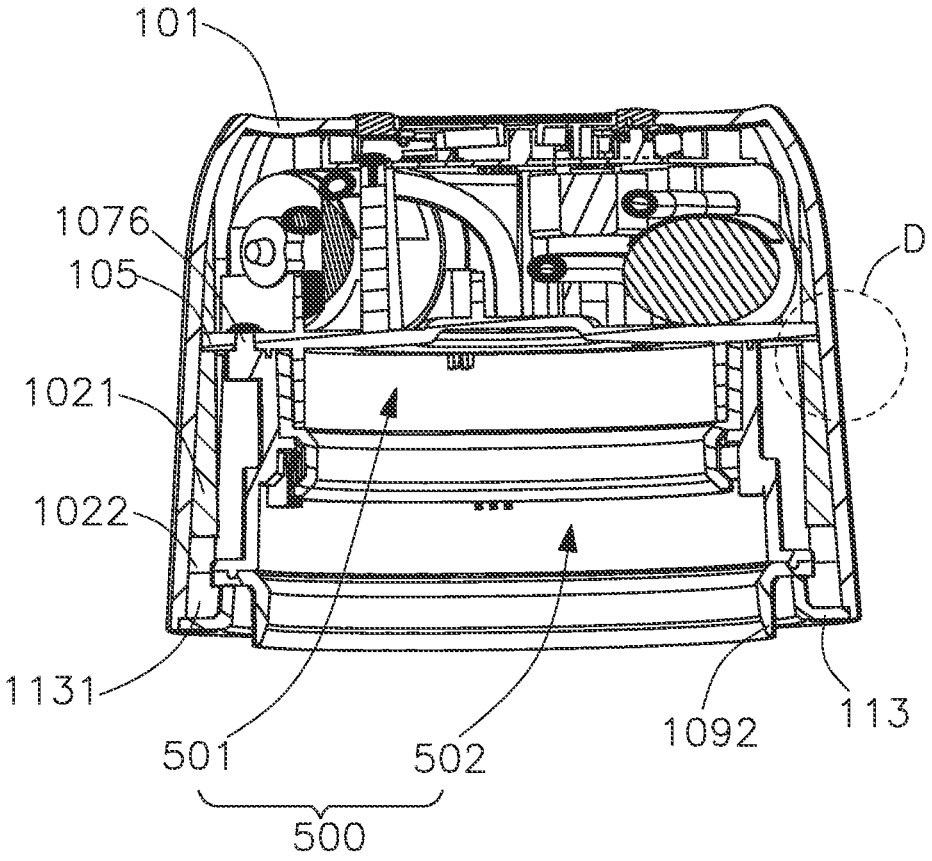
FIG. 12 is a schematic view of a cross-sectional structure of the first container body that is cut along a cross section B-B and that is shown in FIG. 11.
Figure 13:
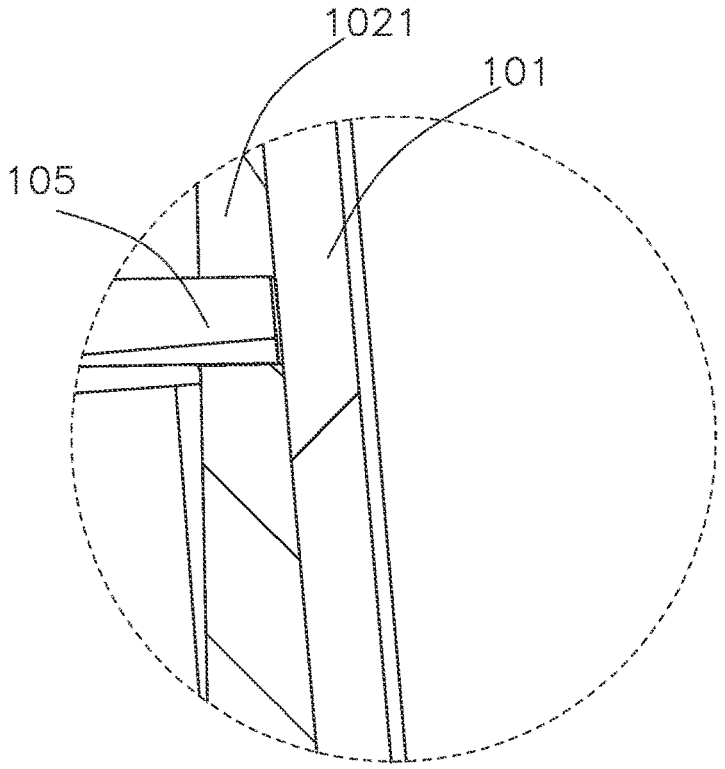
FIG. 13 is an enlarged schematic view of the structure of the first container body shown in FIG. 12 at a position D.
Figure 14:
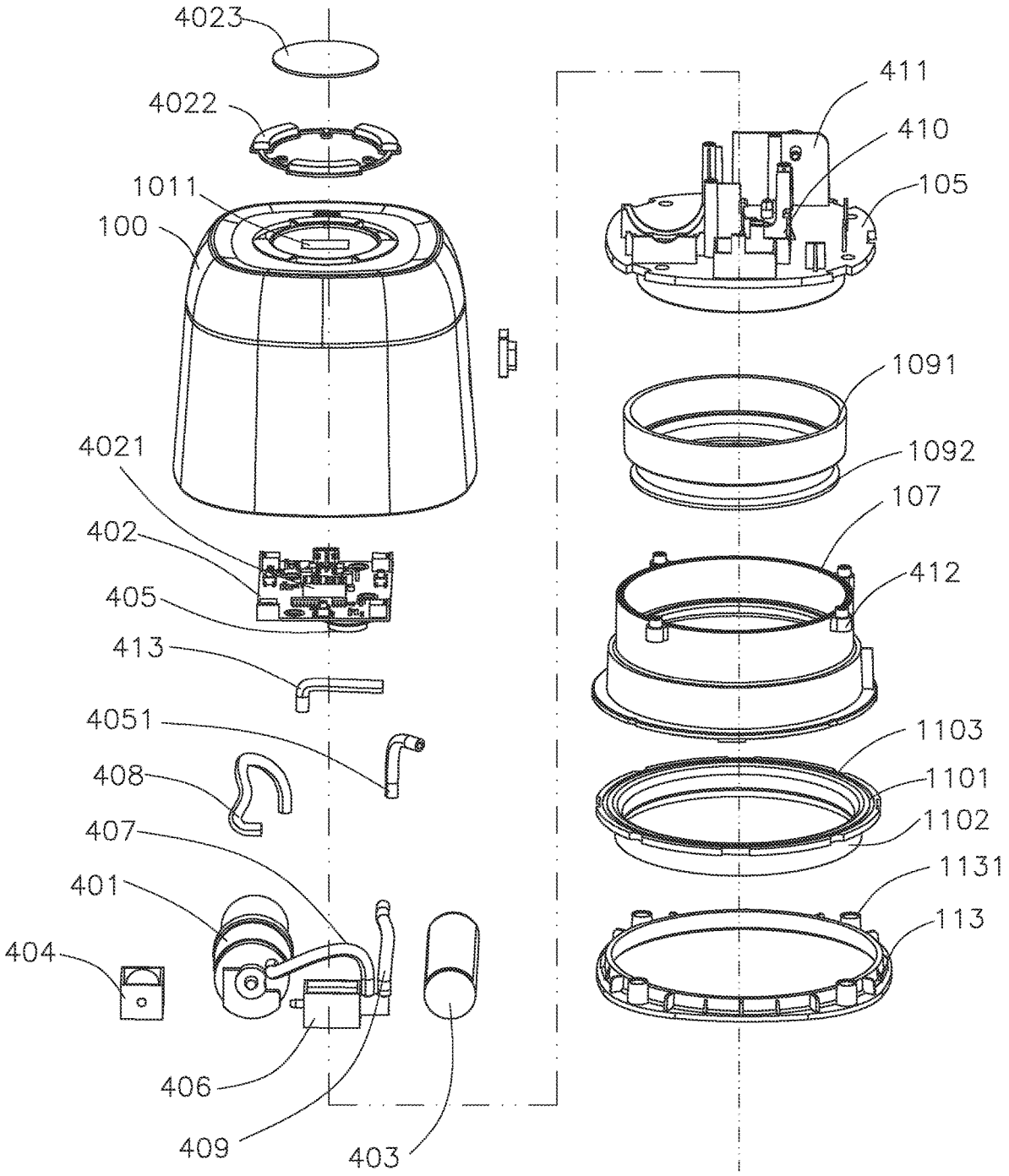
FIG. 14 is an exploded view of the first container body shown in FIG. 7.
Figure 15:
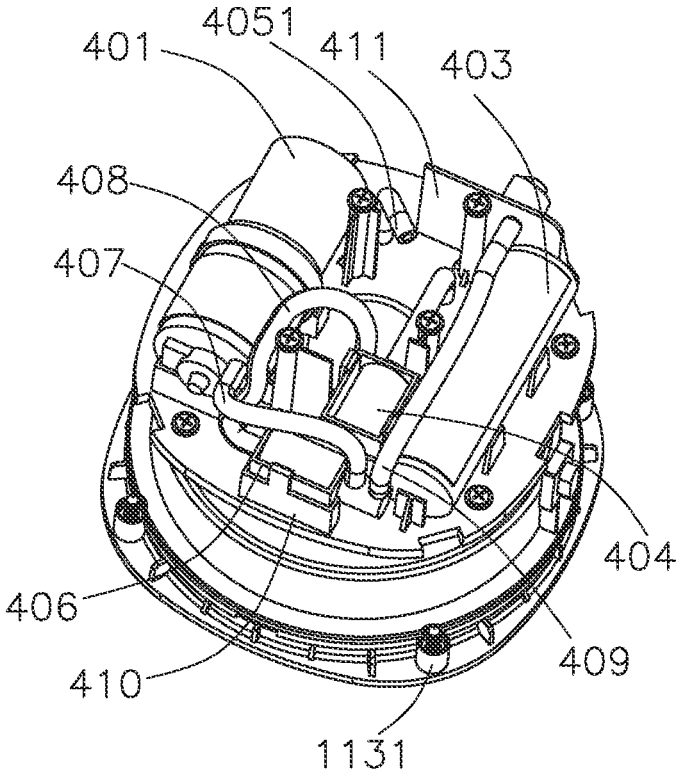
FIG. 15 is a schematic view of the partial structure of the first container body shown in FIG. 7.
Figure 16:
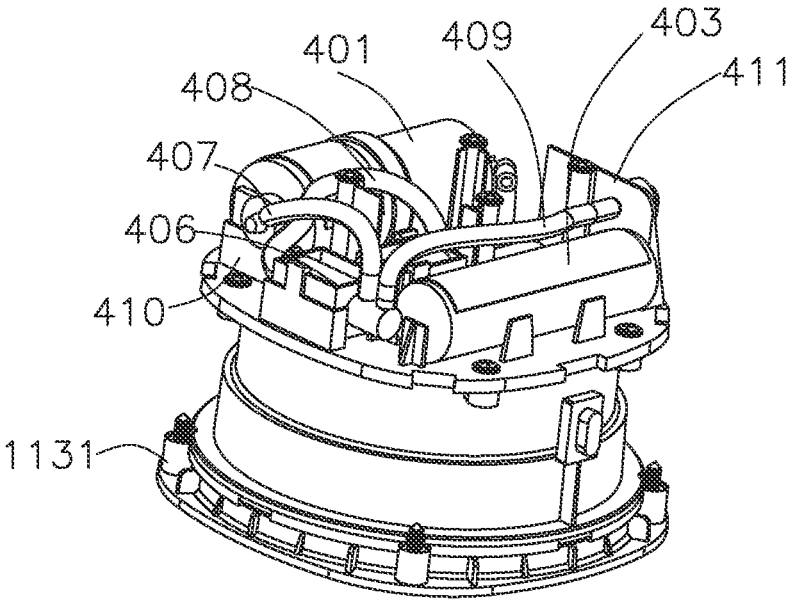
FIG. 16 is a schematic view of the partial structure of the first container body shown in FIG. 15 from another perspective.
Figure 17:
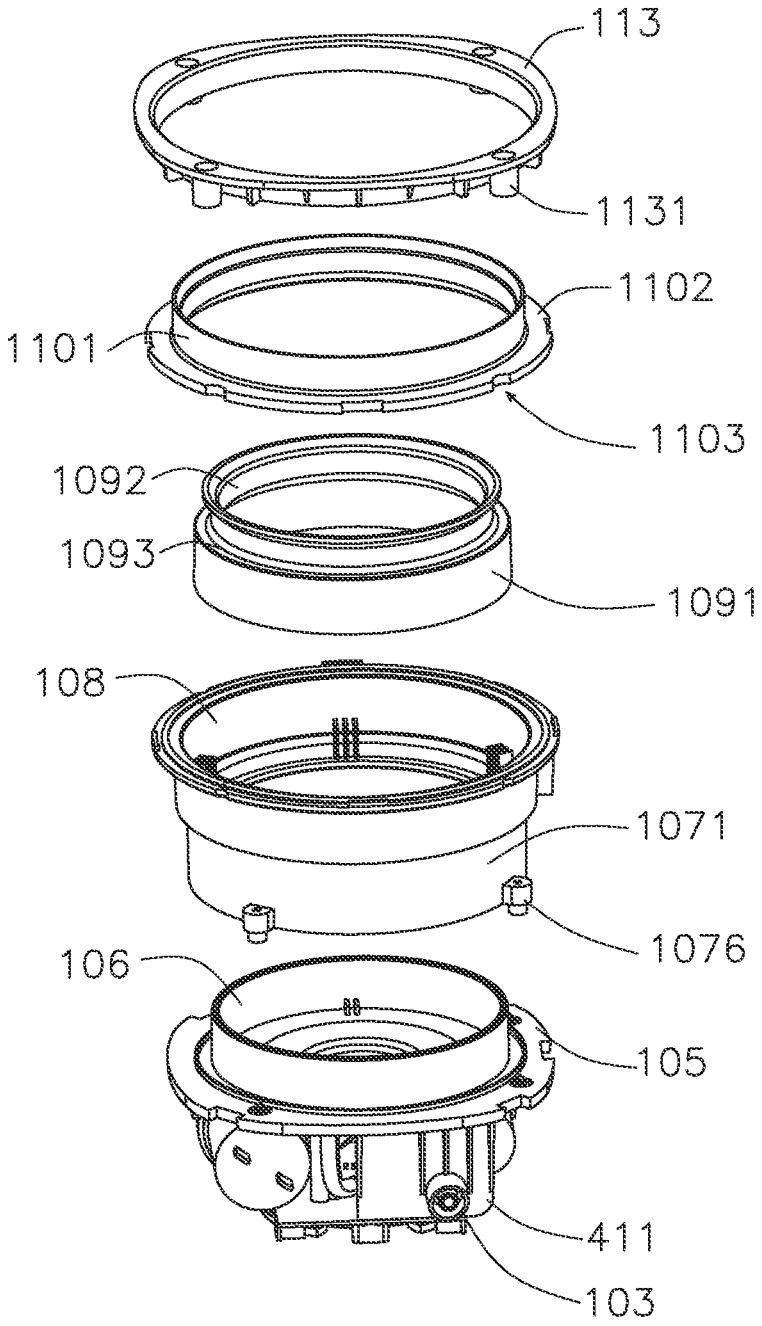
FIG. 17 is an exploded view of the first container body shown in FIG. 16.
Figure 18:
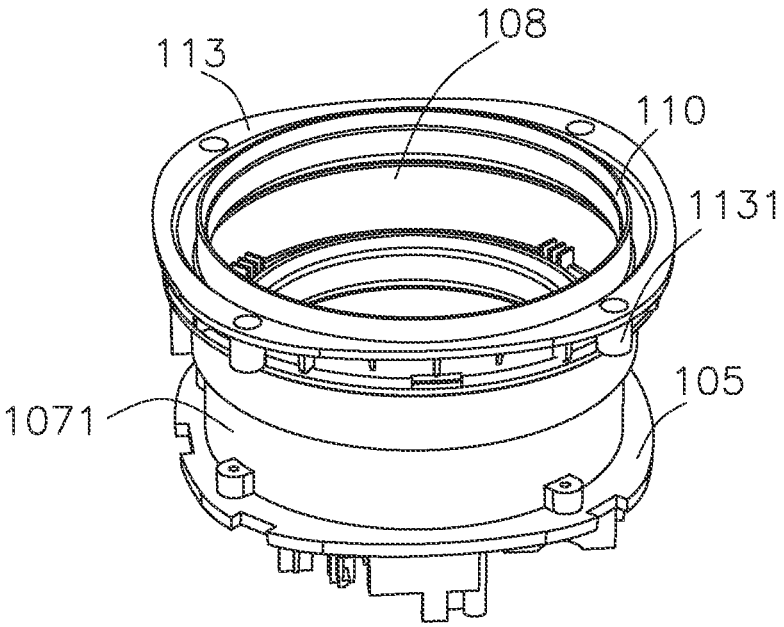
FIG. 18 is a schematic view of the partial structure of the first container body shown in FIG. 7.
Figure 19:
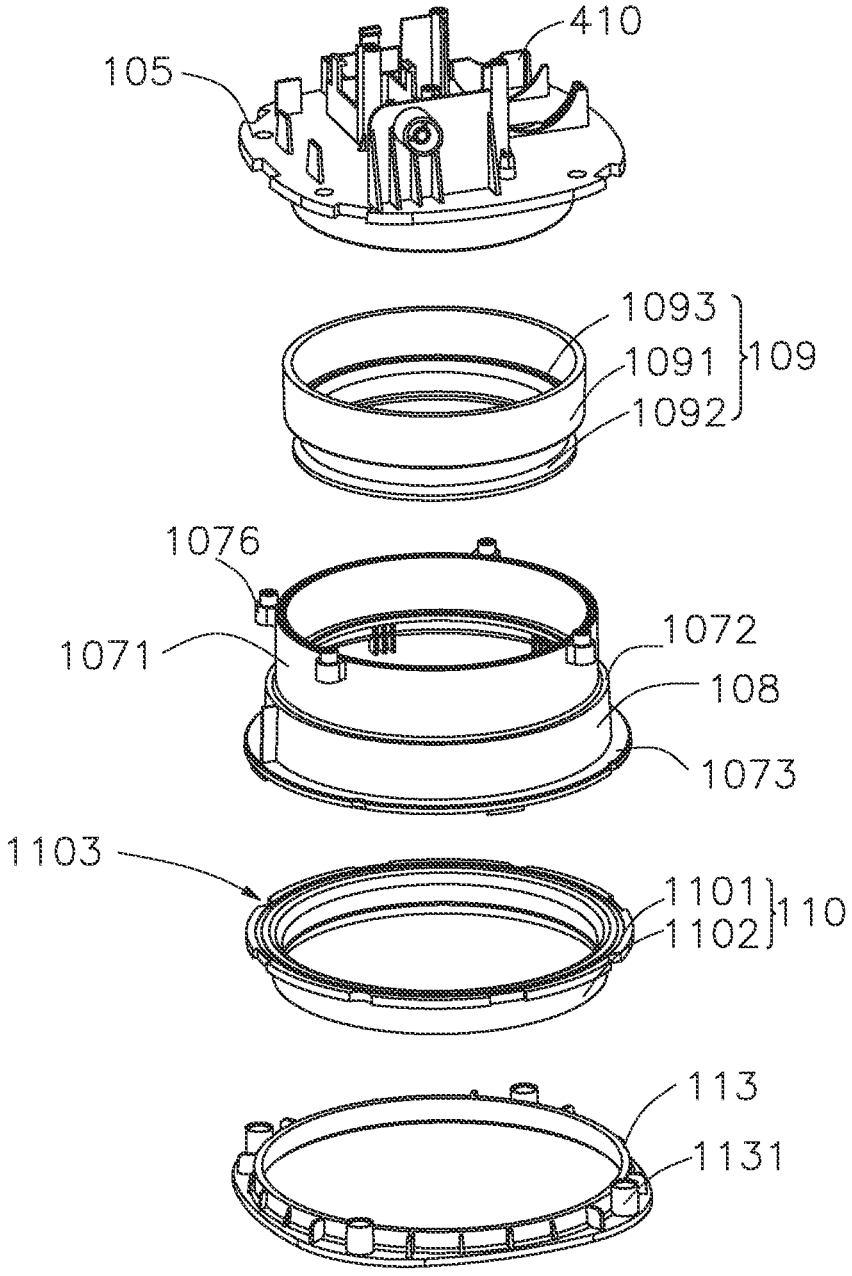
FIG. 19 is an exploded view of the first container body shown in FIG. 18 from another perspective.

As shown in FIGS. 1-23, the present invention provides a mason jar sealing device 1, sealing a first mason jar 601 and a second mason jar 602 with different diameters, including a first container body 100, an external pumping member 200, and an extendable-retractable tube 300 connected between the first container body 100 and the external pumping member 200. The first container body 100 includes a first container part 101, a first container wall 102 surrounding an outer peripheral edge of the first container part 101 and extending away from the first container part 101, a hollow space 10 formed by the first container part 101 together with the first container wall 102 and a first through hole 103 communicated with the hollow space 10. The external pumping member 200 includes a second container body 200*a* and a second through hole 203 extending through the container body 200*a*. The second container body 200*a* includes a second container wall 202 and a second container cover 201 attached on the second container wall 202. The extendable-retractable tube 300 is extendable through the first through hole 103 and second through hole 203. As shown in FIG. 7 (a diagram of the first container body after removing the external pumping member) is the mason jar sealing device 1 provided by the present invention after removing the external pumping member 200. In this embodiment, the extendable-retractable tube 300 is detachably connected to the first and second through holes 103, 203, respectively, so as to facilitate the storage of the mason jar sealing device 1 as well as the separate use of the first container body 10. In other optional embodiments, the extendable-retractable tube may also be integrally connected to one or all of the first through hole and the second through hole.

In this embodiment, the first container body 100 is used to seal mason jars of different sizes, and in addition, the external pumping member 200, which is disposed separately from the first container body 100, can also seal other containers that need to be sealed (e.g., vacuum freshness bags, vacuum storage bags for clothes, etc.), and the extendable-retractable tube 300 facilitates that the external pumping member 200 can be docked in a suitable position and angle with an interface on the container to be sealed.

Figure 2:
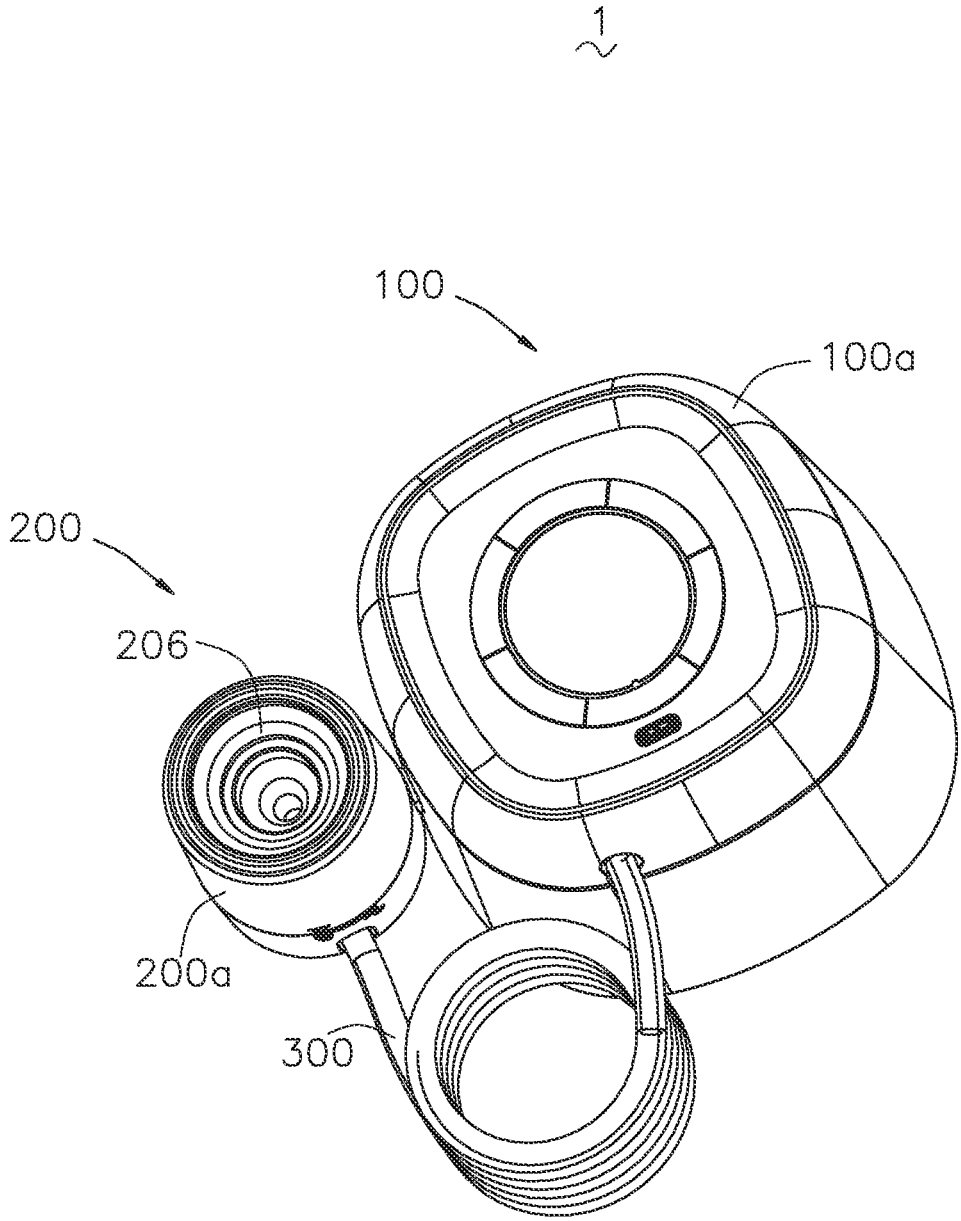
FIG. 2 is a schematic view of the structure of the mason jar sealing device shown in FIG. 1 from another perspective.
Figure 3:
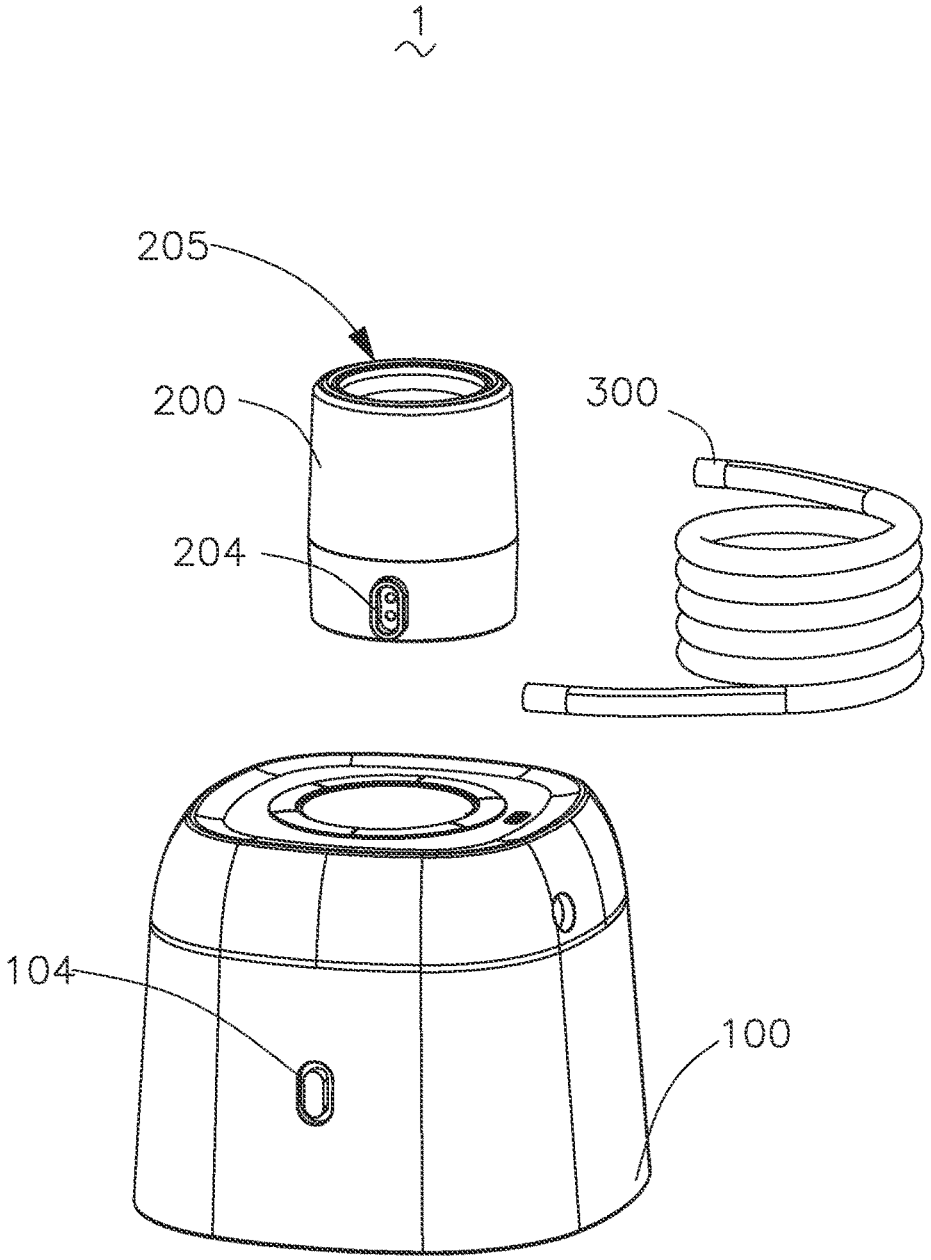
FIG. 3 is an exploded view of the mason jar sealing device shown in FIG. 1.
Figure 4:
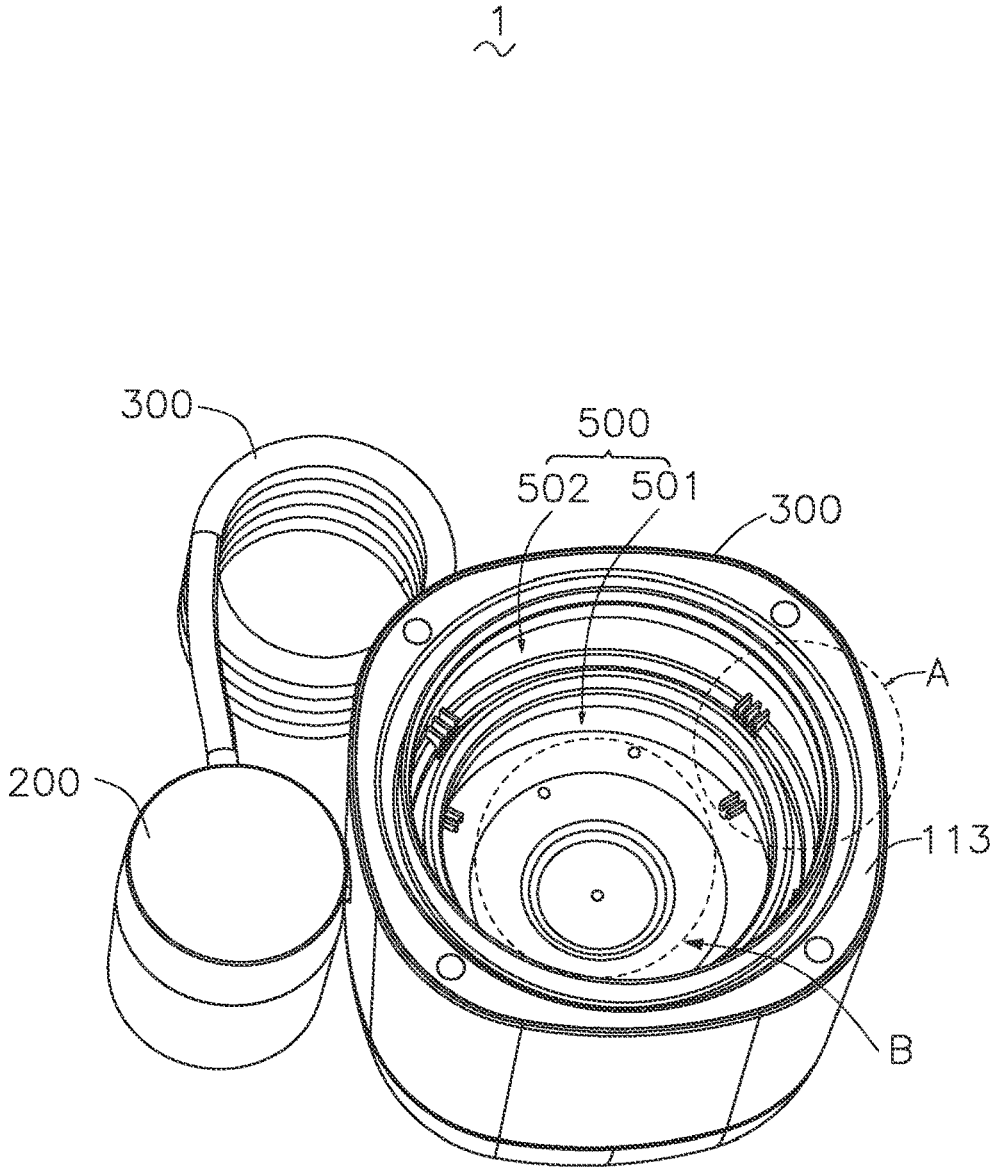
FIG. 4 is a schematic view of the structure of the mason jar sealing device shown in FIG. 1 from another perspective.
Figure 5:
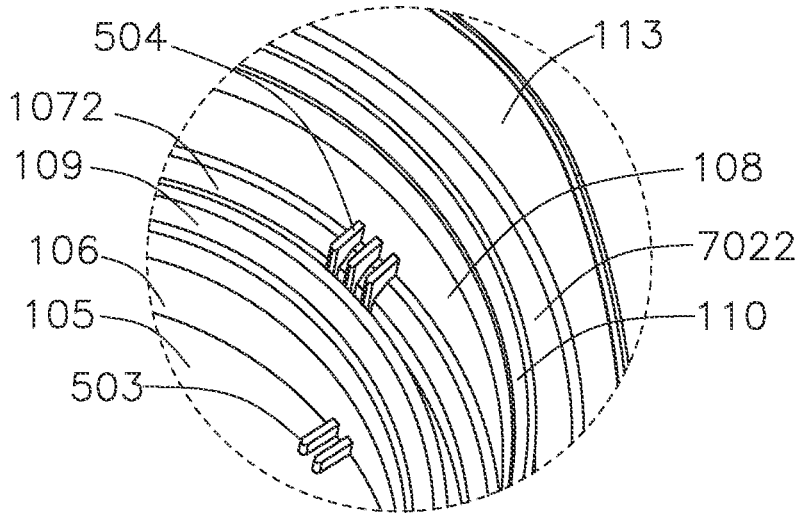
FIG. 5 is an enlarged schematic view of the structure of the mason jar sealing device shown in FIG. 4 at a position A.
Figure 6:
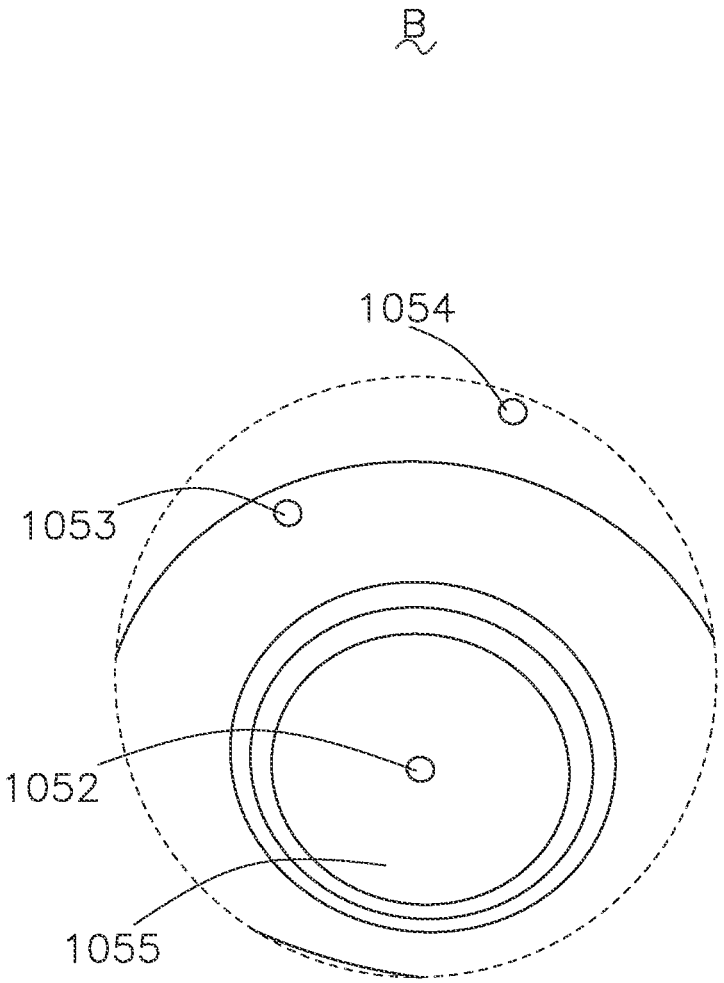
FIG. 6 is an enlarged schematic view of the structure of the mason jar sealing device shown in FIG. 4 at a position B.

A first magnetic component 104 is provided on the first container wall 102 of the first container body 100, and a second magnetic component 204 is correspondingly provided on container body 200*a* of the external pumping member 200, and the first magnetic component 104 and the second magnetic component 204 form a magnetic connection, so as to detachably fix the external pumping member 200 to the first container body 100, thereby facilitating the use of the external pumping member 200, and at the same time avoiding the external pumping member 200 interfering with the use of the first container body 100. It is to be understood that the first magnetic component 104 and the second magnetic component 204 described above may be a magnetic component and a paramagnetic object, respectively, or both of them may be magnetic components. As shown in FIG. 2 and FIG. 3, the second container wall 202 encloses to form a third air-extraction port 205, and a plurality of protrusions 206 of different radial sizes are provided on the inside of the second container wall 202 of the external pumping member 200, specifically, the radial sizes of the plurality of protrusions 206 are progressively increasing along the direction far away from the second container cover 201, so that the external pumping member 200 can be adapted to fit different sealed containers.

As shown in FIGS. 4-9, the first container body 100 of the mason jar sealing device 1 further includes a partition 105 fixed to the inner side of the first container wall 102 and spaced at a relatively spaced apart from the first container part 101. The partition 105 is received in the hollow space 10 and completely surrounded by the first container wall 102.

The partition 105 received in the hollow space 10 for dividing the hollow space 10 into a functional cavity 400 and an air-extraction port 500 formed on a side of the partition 105 away from the functional cavity 400 and adapted to the first mason jar 601 and the second mason jar 602. The first container body 100 includes a reinforcing rib 1021 protruding from the inner side of the first container wall 102 for increasing the structural strength of the first container wall 102 and fixing the partition 105 firmly.

As shown in FIGS. 4-30, the first container body 100 of the mason jar sealing device 1 further includes a first barrel wall 106 arranged on a side of the partition 105 for forming a first air-extraction port 501 together with the partition 105, and a second barrel wall 108 disposed on a side of the first barrel wall 102 away from the partition 105 for forming a second air-extraction port 502 communicated with the first air-extraction port 501. The first barrel wall 106 is completely surrounded by the first container wall 102 and received in the hollow space 10. The second barrel wall 108 is completely surrounded by the first container wall 102 and received in the hollow space 10. The first barrel wall 106 is substantially ring-shaped and placed coaxially with the second barrel wall 108 having a substantially ring-shaped.

An inner diameter of the second barrel wall 108 is greater than an inner diameter of the first barrel wall 106. A projection of the first air-extraction port 501 is completely overlapped with that of the second air-extraction port 502 in a thickness direction of the mason jar sealing device 1. The partition 105 is connected to a first barrel wall 106 toward the side away from the first container part 101 and is integral with the first barrel wall 106 as a whole. In other optional embodiment, the first barrel wall 106 may be detachably connected with the partition 105 for forming a two-piece type.

The first container body 100 of the mason jar sealing device 1 further includes an intermediate component 107 provided in a peripheral ring of the first barrel wall 106 and surrounding the first barrel wall 106. The intermediate component 107 includes a fixation portion 1071 fixed to the partition 105 and extending away from the partition 105, a bent portion 1072 extending from the fixation portion 1071 in a bent direction away from the first barrel wall 106, a second barrel wall 108 extending from the bent portion 1072 in a direction away from the partition 105, and a mounting portion 1073 extending from the second barrel wall 108 towards the first container wall 102.

As shown in FIGS. 6-12, the partition 105 is provided with a positioning ring 1051 protruding towards the side facing away from the first container part 101, and the intermediate component 107 is provided with a corresponding positioning groove 1075. The fixation portion 1071 of the intermediate component 107 is provided with a first bolt post 1076. The intermediate component 107 is screwed and fixed with the partition 105 through the first bolt post 1076 by screws. The fit of the positioning ring 1051 and the positioning groove 1075 can facilitate the positioning of the intermediate frame member 107 during the assembly process, thereby greatly improving the assembly efficiency.

The mason jar sealing device 1 further includes a first sealing portion 109 coupled to the first barrel wall 106 and a second sealing portion 110 coupled to the second barrel wall 108. The first barrel wall 106 and the second barrel wall are secured with the first sealing portion 109 and the second sealing portion 110, respectively, at one end of the first barrel wall 106 and the second barrel wall 108 away from the partition 105. The air-extraction port 500 includes a first air-extraction port 501 enclosed and formed by the first barrel wall 106 together with the first sealing portion 109 and a second air-extraction port 502 enclosed and formed by the second barrel wall 108 together with the second sealing portion 110. As the inner diameter of the second barrel wall 108 is greater than an inner diameter of the first barrel wall 106, the first air-extraction port 501 is configured to install the first mason jar 601 and the second air-extraction port 502 is configured to install the second mason jar 602 with different diameters. Particularly, the first air-extraction port 501 is adapted to fit standard-sized mason jars and the second air-extraction port is adapted to fit wider-sized mason jars. In other optional embodiments, the second barrel wall 108 is detachably connected to the first barrel wall, and the inner diameter of the second barrel wall is smaller than an inner diameter of the first barrel wall, herein the first air-extraction port 501 is adapted to fit wider-sized mason jars and the second air-extraction port is adapted to fit standard-sized mason jars. The mason jar sealing device 1 provided in the present invention can directly adapt different sizes of mason jars at the same time, which facilitates the user to seal different sizes of mason jars.

As shown in FIGS. 8-10 and FIGS. 17-19, The first sealing portion 109 includes a first fixing part 1091, a first sealing part 1092 extending from the first fixing part 1091 and a step portion 1093 sandwiched between the first fixing part 1091 and the first sealing part 1092. The first fixing part 1091 is clamped and fixed between the first barrel wall 106 and the fixation portion 1071 of the intermediate component 107. The first sealing part 1092 is spaced apart from the intermediate component 107 forming a first groove 7021. Furthermore, the intermediate component 107 includes a gripping portion 1074 extending in a direction from the fixation portion 1071 toward a direction away from the first container wall 102 for abutting against the first step portion 1093 to further improve the fixation stability of the first sealing portion 109.

As shown in FIGS. 8-14 and FIGS. 17-19, the mason jar sealing device 1 further includes a mounting ring 113. The mounting ring 113 and the mounting portion 1073 cooperatively clamp and secure the second sealing portion 110. The second sealing portion 110 includes a second fixing part 1101 and a second sealing part 1102 bent downward from the second fixing part 1101. The second fixing part 1101 is gripped and fixed between the mounting portion 1073 of the intermediate component 107 and the mounting ring 113. Specifically, the reinforcing rib 1021 of the first container wall 102 is provided with a second bolt post 1022 at the top, and the mounting ring 113 is provided with a bolt sleeve 1131 that matches the second bolt post 1022, and the bolt sleeve 1131 is socketed to the second bolt post 1022 and secured by screws, thereby securing the mounting ring 113 to one end of the first container wall 102. Further, the second sealing portion 110 is provided with a reservation notch 1103 surrounding the bolt sleeve 1131, and it is understood that the reservation notch 1103 may also serve to locate the second sealing portion 110, thereby solving the problem that the second sealing portion rotates during assembly and installation resulting in a decrease in assembly precision. The intermediate component 107 provided in the present invention cooperatively secures both the first and second sealing portions while forming the second barrel wall for docking the first mason jar 601 and the second mason jar 602, which improves the assembly efficiency while saving the cost of components.

In other optional embodiments, as shown in FIGS. 24-30, the partition 105*a*, the first barrel wall 106*a* and the intermediate component 107*a* are integral as a whole. The first sealing portion 109*a* includes a first fixing part 1091*a* and a first sealing part 1092*a* extending from the first fixing part 1091*a*. The first fixing part 1091*a* is clamped and fixed between the first barrel wall 106*a* and the fixation portion 1071*a* of the intermediate component 107*a*. The second sealing portion 110*a* includes a second fixing part 1101*a* attached on the mounting portion 1073*a* and a second sealing part 1102*a* bent downward from the second fixing part 1101*a*. The shape of the second fixing part 1101*a* is accommodate to the shape of the mounting portion 1073*a*. It is convenient for both the first sealing portion 109*a* and the second sealing portion 110*a* to clean and replace, as both the first sealing portion 109*a* and the second sealing portion 110*a* are fixed detachable. Furthermore, the intermediate component 107*a* is integral with a bolt sleeve 1077*a* as a whole, and the bolt sleeve 1077*a* is socketed to the second bolt post 1022*a* and secured by screws, thereby securing the intermediate component 107*a* to one end of the first container wall 102*a*.

As shown in FIGS. 8-23, the mason jar sealing device 1 further includes a vacuum pump 401 for pumping air, a control circuit board 402 for controlling the operation of the vacuum pump 401, and a battery 403 for supplying power to the vacuum pump 401. The vacuum pump 401, the control circuit board 402 and the battery 403 are housed in the functional cavity 400.

As shown in FIGS. 6-23, the partition 105 includes a recess 1055 recessed towards the functional cavity 400, an air-extraction hole 1052 extending through the partition 105 and arranged on bottom of the recess 1055 for connecting the vacuum pump 401 to the first air-extraction hole 1052 and communicated with the functional cavity 400 and the air-extraction port 500, a decompression hole 1053 extending through the partition 105 and communicated with the functional cavity 400 and the air-extraction port 500 and an air-pressure sensing hole 1054 extending through the partition 105 and communicated with the air-extraction port 500. Further, the mason jar sealing device 1 further includes a decompression valve 404 received in the functional cavity 400 and coupled to the decompression hole 1053 and an air pressure sensor 405 received in the functional cavity 400 and coupled to the air-pressure sensing hole 1054 through a pressure sensing tube 4051. The air-extraction hole 1052 is located at the bottom of the recess 1055 to increase a spacing length between the air-extraction hole 1052 and the mason jar 601 for smoothly drawing out the air in the air-extraction port 500.

Figure 20:
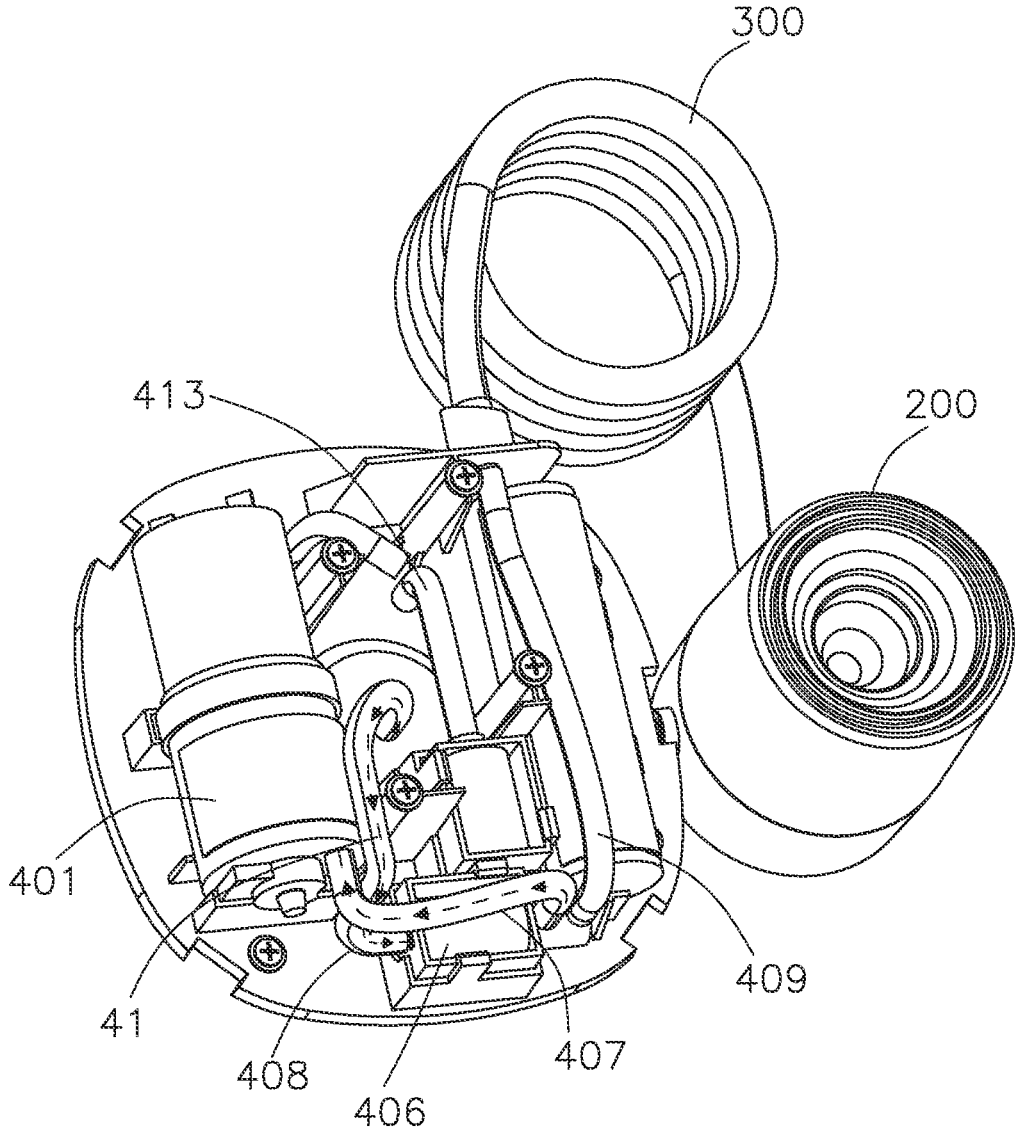
FIG. 20 is a schematic view of the partial structure of the mason jar sealing device shown in FIG. 1 working through the first extraction channel.
Figure 21:
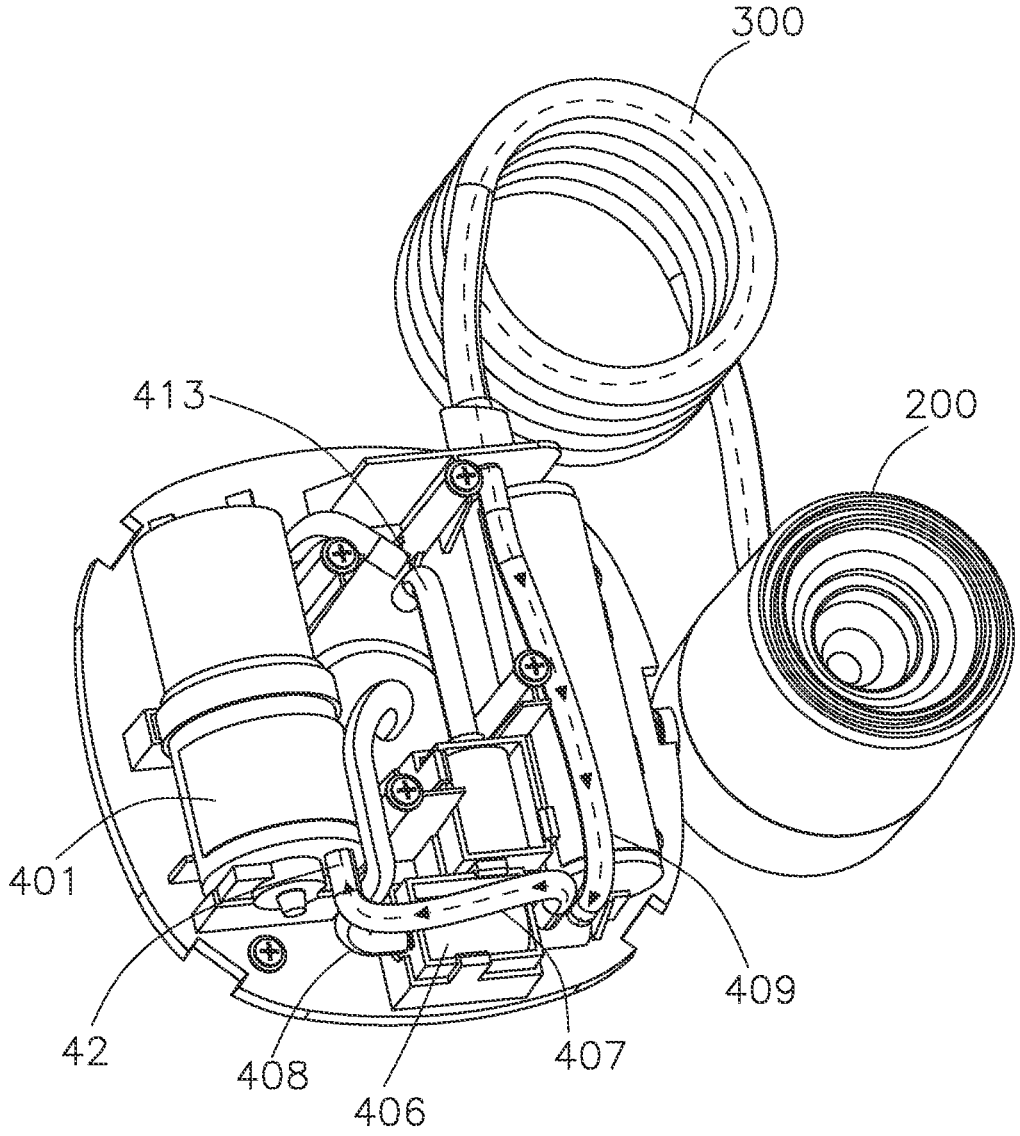
FIG. 21 is a schematic view of the partial structure of the mason jar sealing device shown in FIG. 1 working through the second extraction channel.

As shown in FIGS. 15-16 and 20-21, the mason jar sealing device 1 further includes a three-way valve 406, a first tube 407 coupled to the vacuum pump 401, a second tube 408 coupled to the three-way valve 406 and a third tube 409 coupled to the three-way valve 406 and the first through hole 103. As shown in FIGS. 20-21, the three-way valve 406 is used to switch between the second tube 408 and third tube 409. The three-way valve 406 is switched to couple the first tube 407 and the second tube 408 to form a first extraction channel 41 communicated the vacuum pump 401 with the air-extraction port 500. The three-way valve 406 is switched to couple the first tube 407 and the third tube 409 to form a second extraction channel 42 communicated the vacuum pump 401 with the external pumping member 200. The present invention switches between the two pumping circuits by providing the three-way valve 406 so that it can be easily switched between the external pumping member 200 working state or the first container body 100 working state. Optionally, the three-way valve can be replaced with any type of switch as long as it is configured for switching the external pumping member 200 working state or the first container body 100 working state.

It may be understood that, in other optional embodiments without the external pumping member 200, parts of the corresponding function ((such as a three-way valve, a third tube) can be omitted. As shown in FIGS. 24-30, a first tube 407*a* received in the functional cavity 400*a* and communicating the vacuum pump 401*a* with the air-extraction hole 1052*a*, hence the vacuum pump 401*a* extracts air from the air-extraction port 500*a*.

Figure 29:
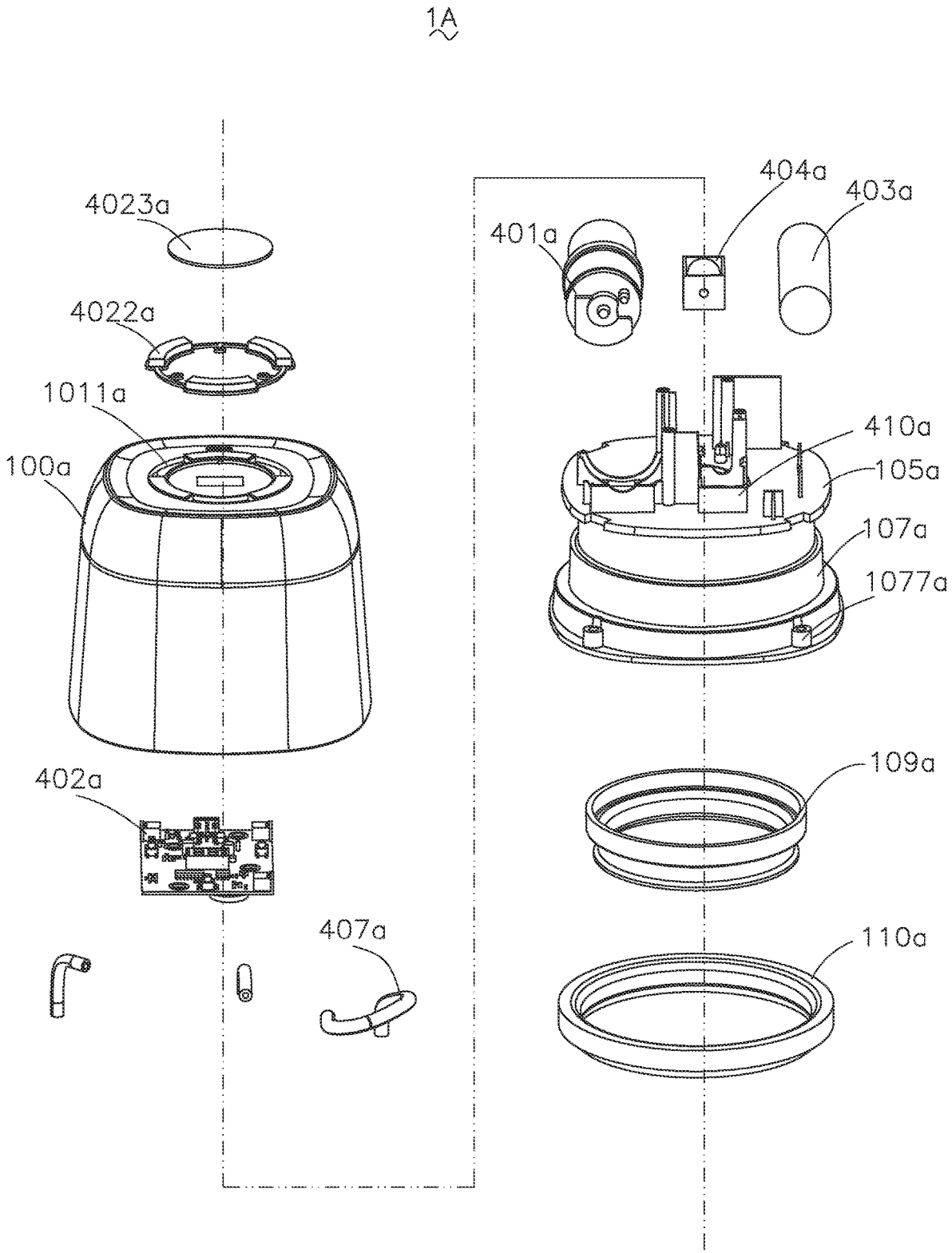
FIG. 29 is an exploded view of the mason jar sealing shown in FIG. 24.
Figure 30:
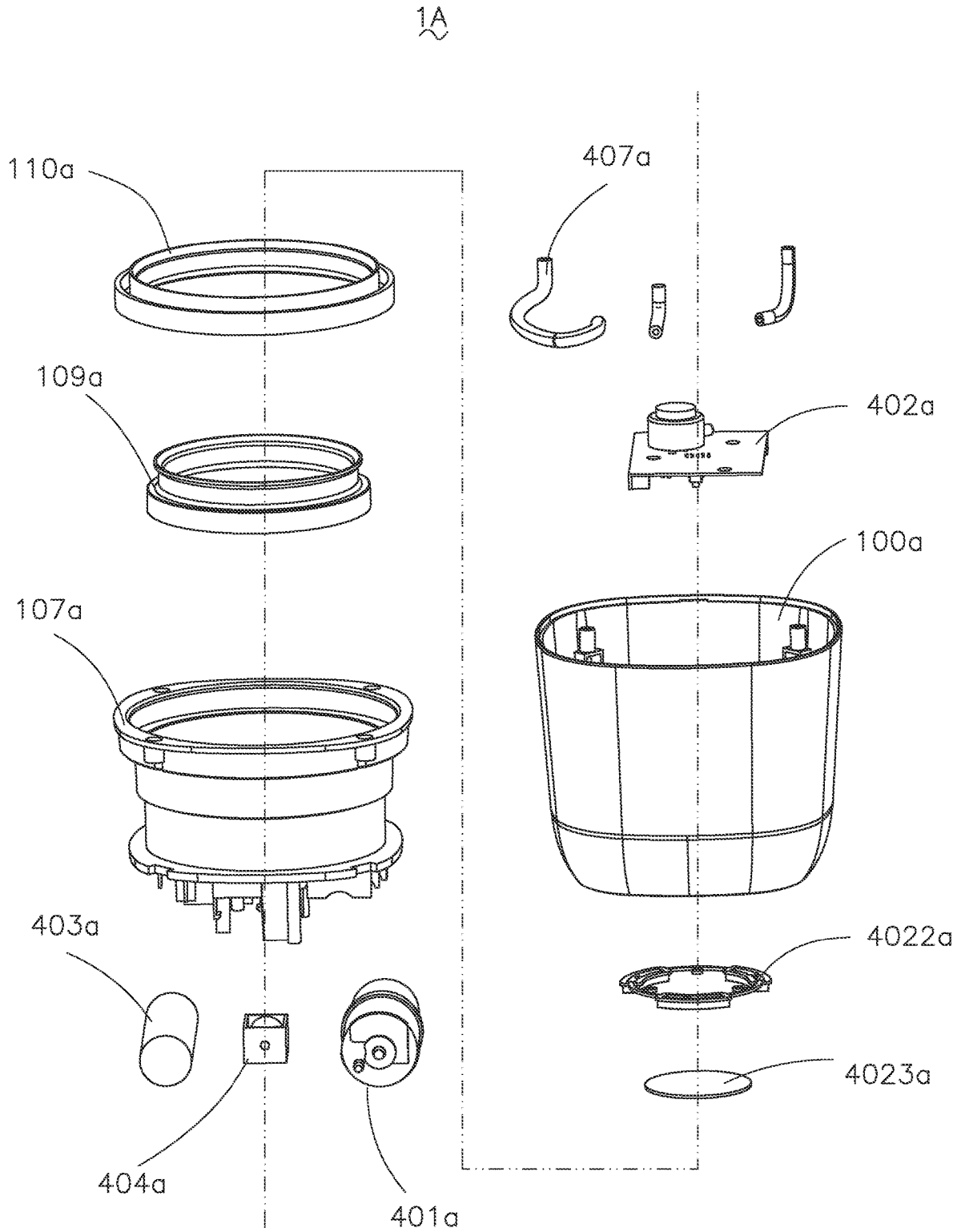
FIG. 30 is a schematic view of the decomposition structure of the mason jar sealing shown in FIG. 24 from another perspective.

As shown in FIGS. 14 and 20-23, the mason jar sealing device further includes a mounting bracket 410 projected from the partition 105 towards the first container part 101 for mounting and fixing the vacuum pump 401, the decompression valve 404, the battery 403, and the three-way valve 406. In other optional embodiments, as shown in FIG. 29, the mounting bracket 410*a* is integrated with the partition 105 and the intermediate component 107*a* as a whole. Specifically, the mounting bracket 410*a*, the intermediate component 107*a*, the first barrel wall 106*a* and the partition 105*a* are integrated as a whole, hence the assembly time can be saved. The mounting bracket 410 not only ensures the stability of the accommodated parts in the functional cavity 400, but also facilitates the arrangement of the air tube connection. Further, as shown in FIGS. 14-23, a mounting plate 411 and a third bolt post 412 extend from the partition 105 towards the first container part 101, respectively. The mounting plate 411 supports the third tube 409 to connect to the first through hole 103, thereby preventing the third tube 409 from falling and disconnecting with the first through hole 103. The control circuit board 402 is fixed to the third bolt post 412 by screws and spaced from the partition 105 and supported on the mounting plate 411, thereby improving the stability of the mounting of the control circuit board 402. The control circuit board 402 is provided with a display panel 4021 and a control button 4022 on the side facing the first container part 101, and the first container part 101 is provided with a through-hole 1011 through the first container part 101 for exposing the display panel 4021 and the control button 4022. Furthermore, a protect panel 4023 is covered over the display panel 4021 to protect the display panel 4021. The control circuit board 402 is spaced apart from the partition 105 for avoiding the short-circuiting of the control circuit board 402 in the event of a malfunction by drawing liquid from the mason jar into the functional chamber 400.

Figure 22:
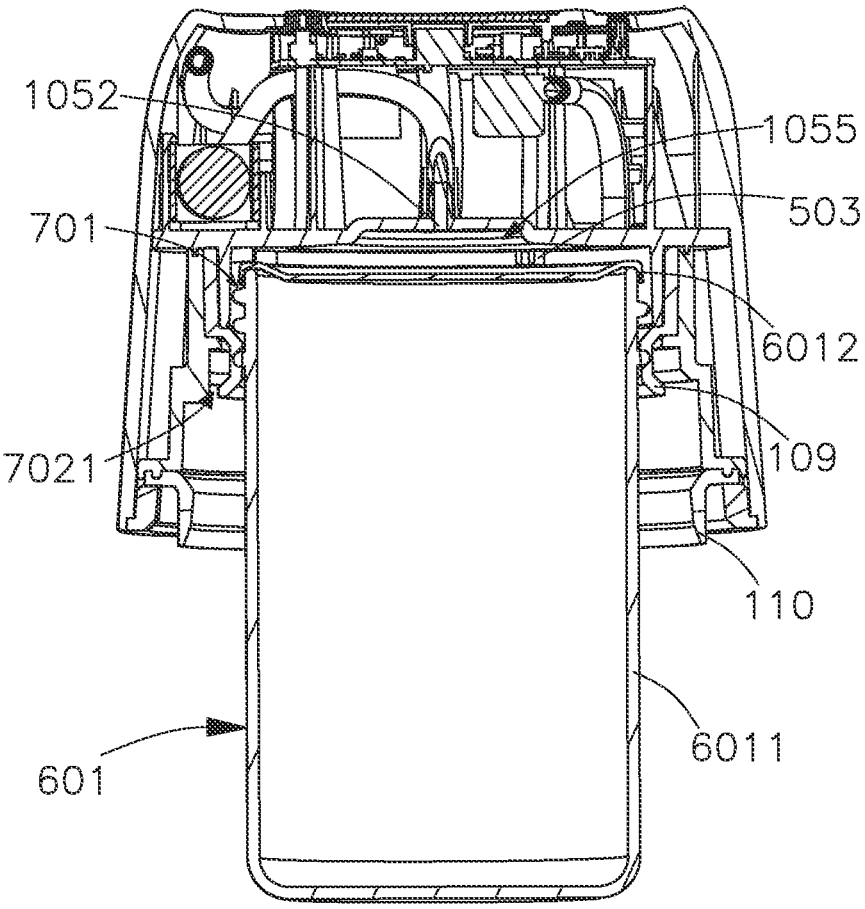
FIG. 22 is a schematic view of a structure obtained after the mason jar sealing device shown in FIG. 1 assembled with the standard-sized mason jar.
Figure 23:
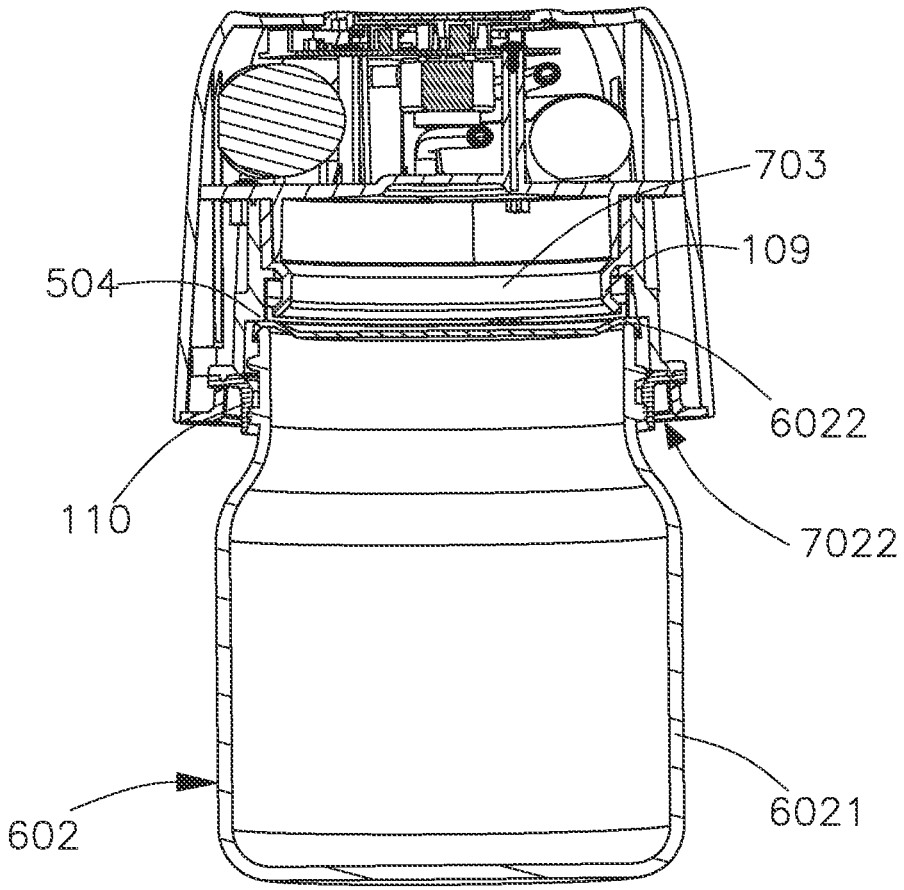
FIG. 23 is a schematic view of a structure obtained after the mason jar sealing device shown in FIG. 1 assembled with the wider-sized mason jar.
Figure 24:
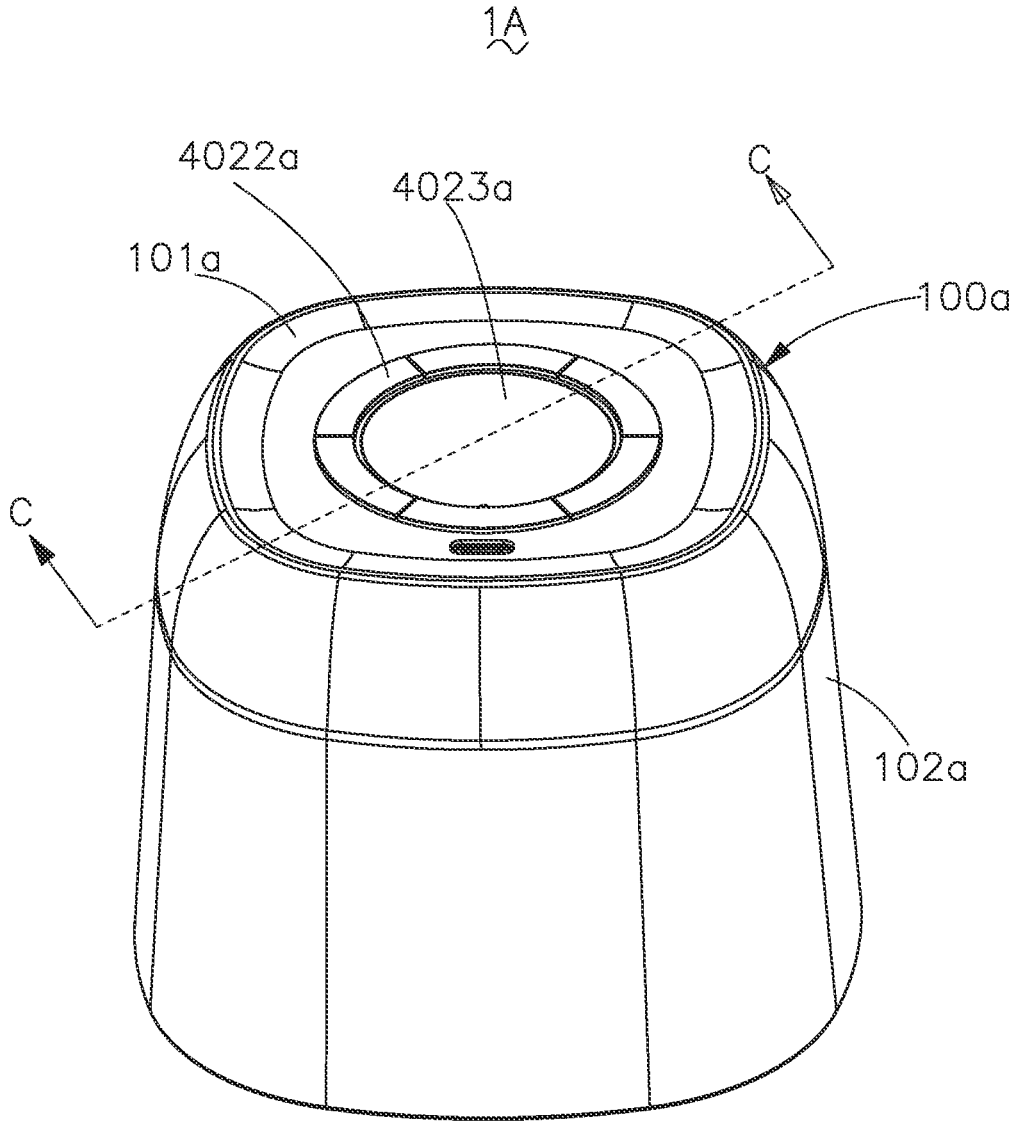
FIG. 24 is a schematic view showing the structure of a mason jar sealing device according to an embodiment of the present invention.
Figure 25:
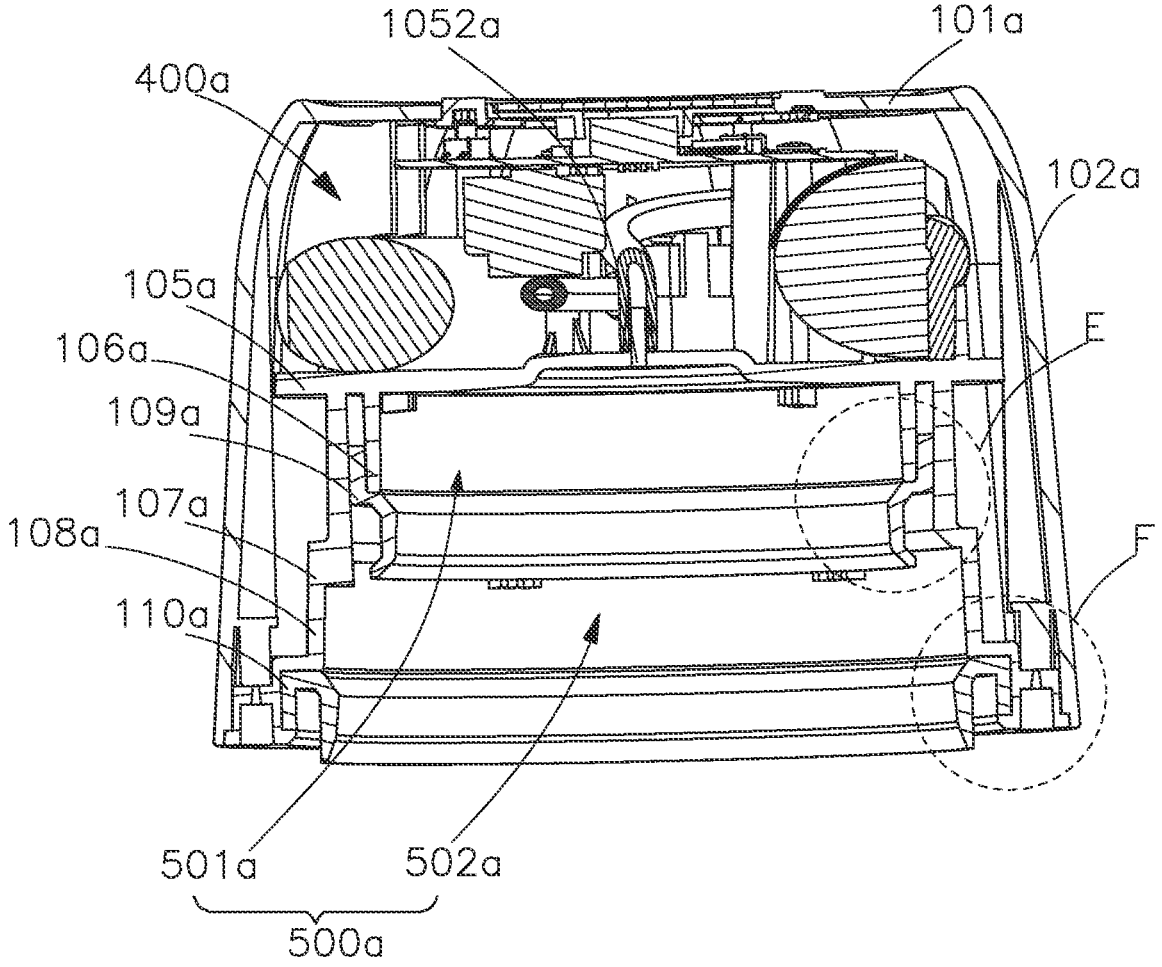
FIG. 25 is a schematic view of a cross-sectional structure of the mason jar sealing device that is cut along a cross section C-C and that is shown in FIG. 24.
Figure 26:
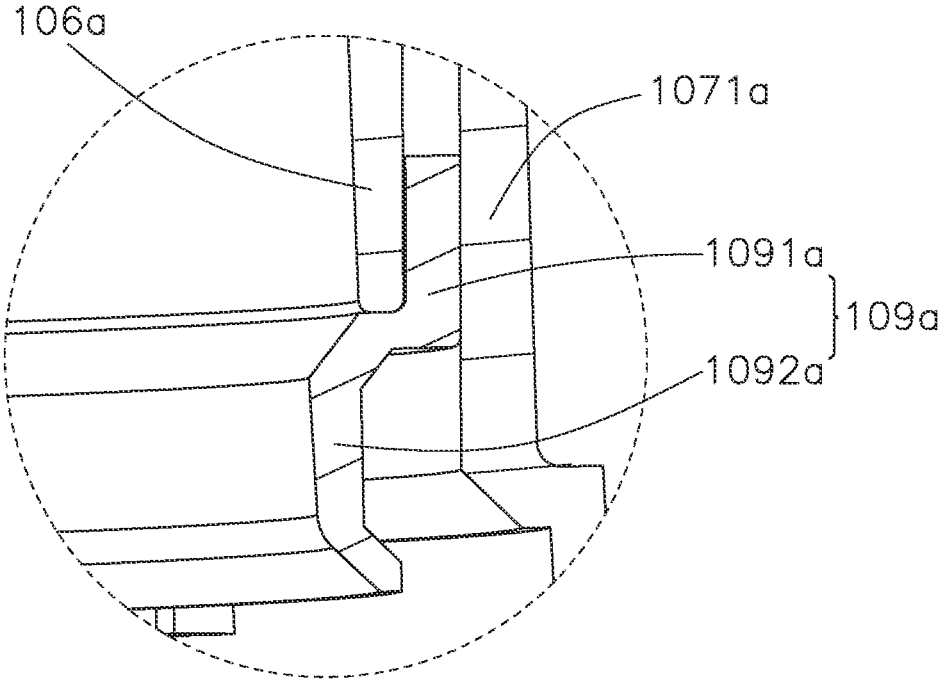
FIG. 26 is an enlarged schematic view of the structure of the mason jar sealing device shown in FIG. 25 at a position E.
Figure 27:
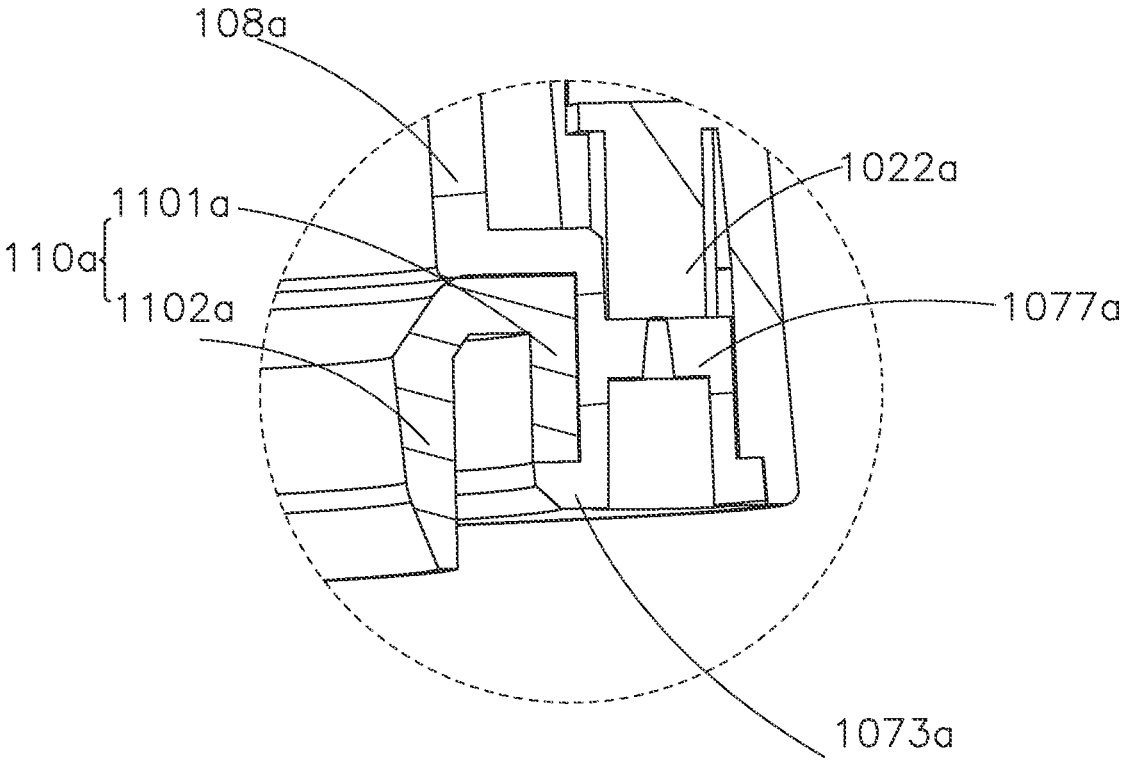
FIG. 27 is an enlarged schematic view of the structure of the mason jar sealing device shown in FIG. 25 at a position F.
Figure 28:
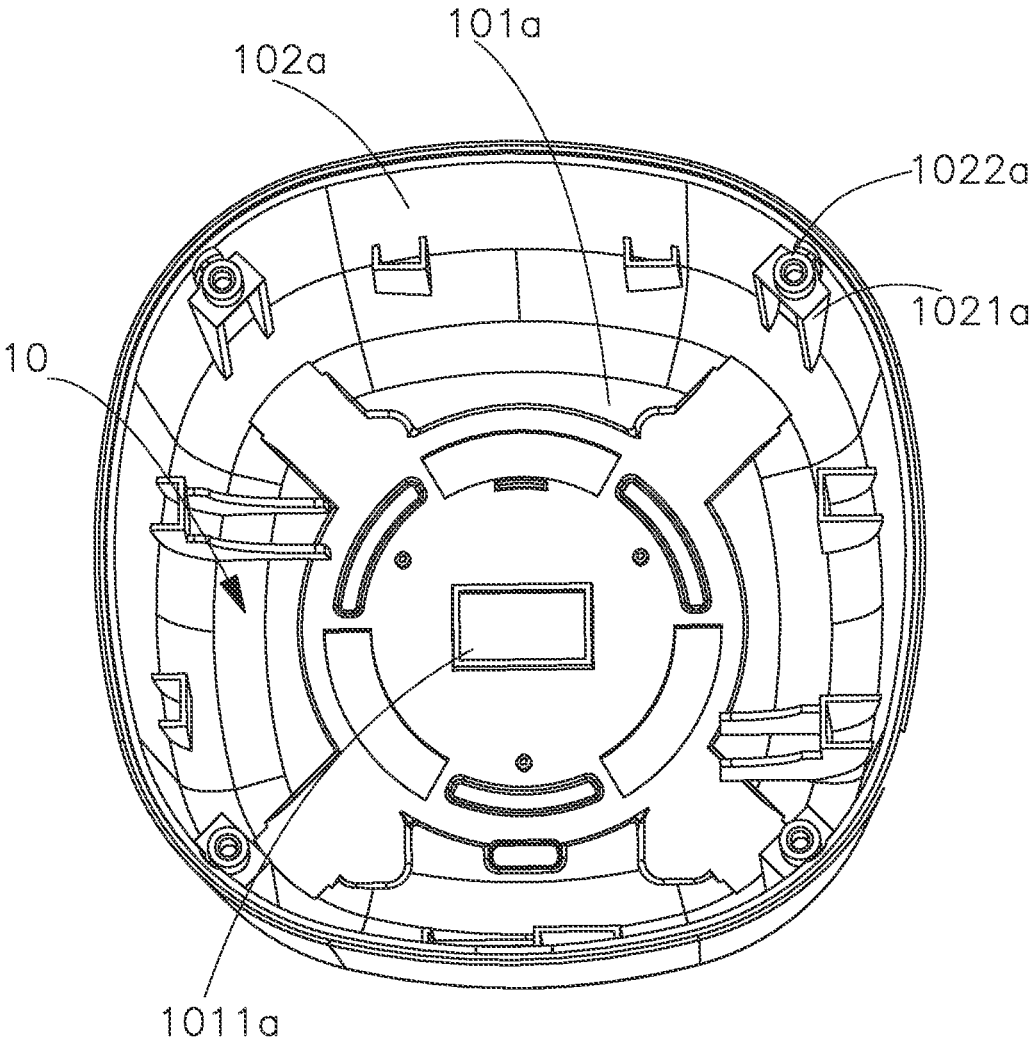
FIG. 28 is a schematic view of the partial structure of the mason jar sealing device shown in FIG. 24.

As shown in FIGS. 22-23, schematic diagrams of the mason jar sealing device 1 provided by the present invention are respectively connected to different sizes of mason jars for sealing work, specifically, FIG. 22 illustrates a schematic diagram of the mason jar sealing device 1 being connected to a standard-sized mason jar (first mason jar) 601 for sealing, and FIG. 23 illustrates a schematic diagram of the mason jar sealing device 1 being connected to a larger-sized mason jar (a second mason jar body with different diameters) 602 for sealing. As shown in FIG. 22, the standard-sized mason jar 601 includes a first bottle 6011 and a first lid 6012 covered on the first bottle 6011 and arranged into a first air-extraction port 501 that matches an outline of the standard-sized mason jar 601. As shown in FIG. 23, the larger-sized mason jar 602 includes a second bottle 6021 and a second lid 6022 covered on the second bottle 6021 and arranged into a second air-extraction port 502 that matches an outline of the larger-sized mason jar 602.

As shown in FIGS. 4-5 and 22-23, the mason jar sealing device 1 further includes at least one first support 503 protruding from the partition 105 and connected to the first barrel wall 106 for being engaged with the first lid 6012 of the standard-sized mason jar 601. In this embodiment, the mason jar sealing device 1 has a plurality of the first supports 503 arranged spacedly and intervally with each other and provided around the partition 105. When assembled, the first bottle 6011 is abutted against the first sealing part 1092 and the first lid 6012 is located in the first air-extraction port 501 and engaged with the first supports 503 for forming a first gap between the first lid 6012, such that the partition 105 cooperates with the first barrel wall 106, the first sealing portion 109 and the first mason jar 601 for forming an airtight first air-extraction chamber 701. In an optional embodiment, the first support is protruded from the partition and spaced apart from the first barrel wall.

In one usage state, the three-way valve 406 is switched to the first extraction channel 41 and the vacuum pump 401 performs air extraction, the air in the standard-sized mason jar 601 is drawn out from the first gap between the first lid 6012 and the first bottle 6011 through the first air-extraction chamber 701. At this time, the negative pressure in the standard-sized mason jar 601 increases, and the first lid 6012 is affected by the pressure and fits on the first bottle 6011. The first groove 7021 provided between the first sealing part 1092 of the first sealing portion 109 and the intermediate component 107 and coupled with the outside atmosphere, so that the first sealing part 1092 will be more closely adhered to the first bottle 6011 to achieve a better sealing effect. During this process, the air-pressure sensor 405 has been sensing the air pressure in the first pumping chamber 701 through the air-pressure sensing hole 1054, and when the air pressure reaches a preset threshold, the vacuum pump 401 is controlled to stop operation through the control circuit board 402. The decompression valve 404 inflates the first pumping chamber 701 through the decompression hole 1053 to equalize the air pressure to facilitate the separation of the vacuum-completed mason jar 601 from the mason jar sealing device 1.

As shown in FIGS. 4-5 and 22-23, the mason jar sealing device 1 further includes at least one second support 504 protruding from the second barrel wall 108 towards the second air-extraction port 502 for being engaged with the second lid 6022 of the larger-sized mason jar 602. In this embodiment, the mason jar sealing device 1 has a plurality of the second supports 504 arranged spacedly and intervally with each other and provided around the second barrel wall 108. When assembled, the second bottle 6021 is abutted against the second sealing part 1102 and the second lid 6022 is located in the second air-extraction port 502 and engaged with the second supports 504 for forming a second gap between the second lid 6022 and the second bottle 6021, such that the second barrel wall 108 cooperates with the second sealing portion 110 and the larger-sized mason jar 602 for forming an airtight second air-extraction chamber 703. In an optional embodiment, the second support is protruded from the second barrel wall and connected with the bent portion.

In another usage state, the three-way valve 406 is switched to the second extraction channel 42 and the vacuum pump 401 performs air extraction, the air in the larger-sized mason jar 602 is drawn out from the second gap between the second lid 6012 and the second bottle 601 through the second air-extraction chamber 702. At this time, the negative pressure in the larger-sized mason jar 602 increases, and the second lid 6022 is affected by the pressure and fits on the second bottle 6021. The second groove 7022 provided between the second sealing part 1102 of the second sealing portion 110 and the first container wall 102 and coupled with the outside atmosphere, so that the second sealing part 1102 will be more closely adhered to the second bottle 6021 to achieve a better sealing effect. During this process, the air-pressure sensor 405 has been sensing the air pressure in the first and second pumping chambers 701, 702 through the air-pressure sensing hole 1054, and when the air pressure reaches a preset threshold, the vacuum pump 401 is controlled to stop operation through the control circuit board 402. The decompression valve 404 inflates the first and second pumping chambers 701, 702 through the decompression hole 1053 to equalize the air pressure to facilitate the separation of the vacuum-completed mason jar 602 from the mason jar sealing device 1.

The present invention provides the mason jar sealing device 1, using for sealing the first mason jar and the second mason jar with different diameters, including the functional cavity 400 for receiving the vacuum pump 401 and the air-extraction port 500 having the first air-extraction port 501 and the second air-extraction port 502 arranged in a direction away from the functional cavity 400 and communicated with the first air-extraction port 501. The first air-extraction port 501 is configured to install the first mason jar 601 and the second air-extraction port 502 is configured to install the second mason jar 602. The first and second air-extraction ports 501, 502 are configured to adapted to fit different sizes of the mason jars 601, 602, respectively.

The above is only an implementation of the present invention, and is not intended to limit the patent scope of the present invention, and any equivalent structure or equivalent process transformation utilizing the contents of the specification of the present invention and the accompanying drawings, or directly or indirectly applying in other related technical fields, are all reasonably included in the scope of patent protection of the present invention.

What is claimed is:

1. A mason jar sealing device, using for sealing a first mason jar and a second mason jar with different diameters and comprising a first container body, the first container body comprising:
- a first container part;
- a first container wall, the first container wall surrounding the first container part and extending from the first container part;
- a partition, the partition coupled to an inner side of the first container wall and spaced apart from the first container part;
- a first barrel wall, the first barrel wall coupled with the partition for forming a first air-extraction port together with the partition, the first barrel wall is configured to be coupled with the first mason jar; and
- a second barrel wall, the second barrel wall disposed on a side of the first barrel wall away from the partition for forming a second air-extraction port for communicating with the first air-extraction port, the second barrel wall is configured to be coupled with the second mason jar;
- wherein when the second barrel wall is coupled with the second mason jar, the first barrel wall remains coupled with the partition; and
- wherein the inner diameter of the second barrel wall is greater than the inner diameter of the first barrel wall.

2. The mason jar sealing device according to claim 1, wherein the mason jar sealing device further comprises a first sealing portion coupled to the first barrel wall, when the second barrel wall is coupled with the second mason jar, the first sealing portion remains coupled to the first barrel wall.

3. The mason jar sealing device according to claim 2, wherein the mason jar sealing device further comprises a second sealing portion coupled to the second mason jar.

4. The mason jar sealing device according to claim 1, wherein the first barrel wall is received in the first container wall and completely surrounded by the first container wall.

5. The mason jar sealing device according to claim 4, wherein the second barrel wall is received in the first container wall and completely surrounded by the first container wall.

6. The mason jar sealing device according to claim 1, wherein the first container body comprises an intermediate component attached on the partition and surrounding the first barrel wall, and the second barrel wall attached on the intermediate component.

7. The mason jar sealing device according to claim 6, wherein the intermediate component comprises a fixation portion fixed to and extending away from the partition, and a bent portion extending from the fixation portion away from the first container part and bent towards the first container wall, the second barrel wall extending from the bent portion in a direction away from the partition.

8. The mason jar sealing device according to claim 6, wherein the mason jar sealing device further comprises a first sealing portion coupled to the first barrel wall and the intermediate component comprises a fixation portion fixed to and extending away from the partition and a gripping portion extending from the fixation portion in a direction towards the first air-extraction port for abutting against the first sealing portion.

9. The mason jar sealing device according to claim 6, wherein the partition comprises a positioning ring arranged on and protruding from a side of the partition away from the first container part, the intermediate component comprises a fixation portion fixed to and extending away from the partition, the fixation portion of the intermediate component comprises a positioning groove coupled to the positioning ring.

10. The mason jar sealing device according to claim 6, wherein the partition, is integral with the first barrel wall and the intermediate component as a whole.

11. The mason jar sealing device according to claim 6, wherein the mason jar sealing device further comprises a mounting ring and a second sealing portion coupled to the second barrel wall, and the intermediate component further comprises a mounting portion extending from the second barrel wall towards the first container wall, the mounting ring and the mounting portion cooperatively clamp to secure the second sealing portion.

12. The mason jar sealing device according to claim 1, wherein the first mason jar comprises a first bottle and a first lid covered on the first bottle, the mason jar sealing device further comprises at least one first support protruding from the partition for being engaged with the first lid to form a first gap located between the first lid and the first bottle, the air of the first mason jar is drawn out from the first gap.

13. The mason jar sealing device according to claim 1, wherein the second mason jar comprises a second bottle and a second lid covered on the second bottle, the mason jar sealing device further comprises at least one second support protruding from the second barrel wall for being engaged with the second lid to form a second gap located between the second lid and the second bottle, the air of the second mason jar is drawn out from the second gap.

14. The mason jar sealing device according to claim 1, wherein the partition and the first container part cooperatively define a functional cavity for receiving a vacuum pump, wherein an air-extraction hole extending through the partition for communicating the vacuum pump with the air-extraction hole.

15. The mason jar sealing device according to claim 14, wherein the partition defines a recess recessed from the first air-extraction port and towards the functional cavity and communicated with the first air-extraction port, and the air-extraction hole arranged on bottom of the recess.

16. The mason jar sealing device according to claim 14, wherein the partition further defines an air-pressure sensing hole extending therethrough the partition, the mason jar sealing device further comprises an air pressure sensor received in the functional cavity and coupled to the air-pressure sensing hole.

17. The mason jar sealing device according to claim 14, wherein the mason jar sealing device further comprising an external pumping member detachably coupled with the first container body and an extendable-retractable tube communicating the external pumping member with the first container body.

18. The mason jar sealing device according to claim 17, wherein the first container body further comprises a first through hole, and the external pumping member comprises a second through hole, the extendable-retractable tube is extendable through the first and second through holes.

19. The mason jar sealing device according to claim 18, wherein the extendable-retractable tube is detachably connected to the first through hole.

20. The mason jar sealing device according to claim 18, wherein the mason jar sealing device further comprises a three-way valve, a first tube communicating the vacuum pump with the three-way valve, and a second tube communicating the three-way valve with the air-extraction hole.

21. The mason jar sealing device according to claim 20, wherein the mason jar sealing device further comprises a third tube communicating the three-way valve with the first through hole.

22. The mason jar sealing device according to claim 1, wherein the first mason jar comprises a first bottle and a first lid covered on the first bottle, the mason jar sealing device further comprises at least one first support connected to the first barrel wall for being engaged with the first lid to form a first gap located between the first lid and the first bottle, the air of the first mason jar is drawn out from the first gap.

23. A mason jar sealing device, using for sealing a first mason jar and a second mason jar with different diameters, comprising:

a first container body, the first container body comprising:

a first container part;

a first container wall, the first container wall surrounding the first container part and extending from the first container part;

a partition, the partition coupled to an inner side of the first container wall and spaced apart from the first container part;

a first barrel wall, the first barrel wall coupled with the partition for forming a first air-extraction port together with the partition, the first barrel wall is configured to be coupled with the first mason jar; and a second barrel wall, the second barrel wall disposed on a side of the first barrel wall away from the partition for forming a second air-extraction port for communicating with the first air-extraction port, the second barrel wall is configured to be coupled with the second mason jar;

wherein when the second barrel wall is coupled with the second mason jar, the first barrel wall remains coupled with the partition; and wherein when the first barrel wall is coupled with the first mason jar, the second barrel wall is attached to the partition by an intermediate component.

24. The mason jar sealing device according to claim 23, wherein the first mason jar comprises a first bottle and a first lid covered on the first bottle, the mason jar sealing device further comprises at least one first support protruding from the partition for abutting against the first lid of the first mason jar.

25. The mason jar sealing device according to claim 23, wherein the second mason jar comprises a second bottle and a second lid covered on the second bottle, the mason jar sealing device further comprises at least one second support protruding from the second barrel wall for abutting against the second lid of the second mason jar.

* * * * *